US011384532B2

(12) United States Patent
Wiedebush

(10) Patent No.: US 11,384,532 B2
(45) Date of Patent: Jul. 12, 2022

(54) STRUCTURAL CONNECTION SYSTEM FOR MODULAR FRAMEWORKS

(71) Applicant: Richard T. Wiedebush, Baltimore, MD (US)

(72) Inventor: Richard T. Wiedebush, Baltimore, MD (US)

( * ) Notice: Subject to any disclaimer, the term of this patent is extended or adjusted under 35 U.S.C. 154(b) by 0 days.

(21) Appl. No.: 17/483,107

(22) Filed: Sep. 23, 2021

(65) Prior Publication Data

US 2022/0098852 A1 Mar. 31, 2022

Related U.S. Application Data

(60) Provisional application No. 63/083,734, filed on Sep. 25, 2020.

(51) Int. Cl.

| | |
|---|---|
| ***E04B 1/58*** | (2006.01) |
| ***E04B 1/41*** | (2006.01) |
| ***E04B 1/343*** | (2006.01) |
| *E04B 2/60* | (2006.01) |

(52) U.S. Cl.

CPC ..... *E04B 1/5831* (2013.01); *E04B 1/34326* (2013.01); *E04B 1/40* (2013.01); *E04B 2/60* (2013.01); *E04B 2001/5862* (2013.01)

(58) Field of Classification Search

CPC ..... E04B 1/40; E04B 1/34326; E04B 1/5831; E04B 2001/1915; E04B 2001/1918; E04B 2001/1921; E04B 2001/1966; E04B 2001/2406; E04B 2001/2451; F16B 7/185;

(Continued)

(56) References Cited

U.S. PATENT DOCUMENTS

| | | | | |
|---|---|---|---|---|
| 3,864,051 A * | 2/1975 | Reid | F16B 7/0446 411/180 |
| 4,044,497 A * | 8/1977 | Bettens | A63H 33/065 446/96 |
| 6,854,238 B2 | 2/2005 | Boots | |

(Continued)

FOREIGN PATENT DOCUMENTS

| | | | |
|---|---|---|---|
| CA | 1261114 A * | 9/1989 | E04H 15/34 |
| DE | 102013013216 A1 * | 2/2015 | F16B 7/185 |
| DE | 202019105392 U1 * | 1/2021 | E04B 1/1903 |

OTHER PUBLICATIONS

International Search Report, PCT/US21/51685, dated Jan. 5, 2022; 3 pages.

(Continued)

*Primary Examiner* — Christine T Cajilig

(74) *Attorney, Agent, or Firm* — Jennings, Strouss & Salmon P.L.C.

(57) ABSTRACT

The present invention provides a construction set suitable for creating a variety of structures and includes a plurality of elements. A modular construction system includes hubs which are embodied as solid-surfaced hexahedrons having at least one flanged protrusion on at least two faces of each hexahedron. Adjacent structural bodies in the modular construction system may be connected to as few as one face of a hub, or to as many as all six faces, by means of attachable connector elements. The hexahedron at the core of the hub may be of the same or larger dimensions relative to the cross-section of the framing materials (e.g., lumber, tubing, composites, metals, extruded members) it connects.

17 Claims, 25 Drawing Sheets

(58) Field of Classification Search
CPC ... F16B 7/22; A63F 2009/1232; Y10T 403/44
USPC ..... 52/655.1
See application file for complete search history.

(56) References Cited

U.S. PATENT DOCUMENTS

| | | | | |
|---|---|---|---|---|
| D506,790 | S * | 6/2005 | Gee | D21/479 |
| 7,198,270 | B1 * | 4/2007 | Bishop | A63F 9/12 273/153 S |
| 7,967,401 | B2 * | 6/2011 | Hsu | A47B 47/0033 312/257.1 |
| 9,238,179 | B2 * | 1/2016 | Carpenter | A63H 33/062 |
| 10,029,187 | B2 * | 7/2018 | Liu | A63H 33/08 |
| 10,036,156 | B1 | 7/2018 | Macdonald et al. | |
| 10,501,929 | B2 * | 12/2019 | Henry | E04B 1/2604 |
| 2008/0280521 | A1 * | 11/2008 | Bishop | A63H 33/082 446/124 |
| 2015/0377414 | A1 * | 12/2015 | Pirseyedi | F16B 21/09 403/205 |
| 2019/0024364 | A1 * | 1/2019 | Lestini | E04H 1/005 |

OTHER PUBLICATIONS

Written Opinion of the International Search Authority, PCT/US21/51685, dated Jan. 5, 2022; 5 pages.

* cited by examiner

STRUCTURAL CONNECTION SYSTEM FOR MODULAR FRAMEWORKS

REFERENCE TO RELATED APPLICATION

The present application claims the priority to U.S. Provisional Patent Application Ser. No. 63/083,734, filed Sep. 25, 2020, the entire contents of which are hereby incorporated herein by this reference.

TECHNICAL FIELD

The present invention relates to structural systems. More particularly, the present invention relates to modular systems for the construction of frameworks of various sizes, purposes, and material compositions.

BACKGROUND

Framing materials comprise the structural framework for permanent, semi-permanent, and temporary free-standing structures, allowing for durable and stable structures. All such structures can benefit from modularity in many ways. Modular framing systems can be readily assembled, disassembled, added to, and subtracted from. As such they can be made larger or smaller; reconfigured spatially; reconfigured aesthetically; re-purposed; reconfigured of different materials; adorned with attachments for aesthetic, functional, or branding purposes; etc.

Modular framing systems make them easy to install, uninstall, move, or reconfigure utilizing a small number of people or machines. In a preferred configuration, in which the connectors and structural members are joined at the site of manufacture, this system requires no tools to assemble, disassemble, or reconfigure.

Modular framing systems can be used to create a wide variety of frames and structures for myriad purposes. Indoor applications include furniture (e.g., shelving, closet organization systems, aquariums, terrariums, office systems, desks, tables, chairs, folding tables, folding chairs, workbenches, workstations, cubicles, stanchions, privacy screens, dressing areas, restroom stalls, display shelving, display racks, display wall systems, display hooks and holders) stands (e.g., for tools, audio/video components, including speaker stands and audio/visual equipment racks, camera and equipment tripods, and hanging platforms to suspend items from walls or ceilings) decorative framing (e.g., picture and art frames) mounting systems and hangers (e.g., for cabinets; appliances; picture frames; mirrors; curtains; lighting systems, wall panels; wall displays; media racks for brochures, magazines, promotional materials, and the like; retail displays; parts racks and bins) and more permanent structures (e.g., walls and partitions, floors and sub-floors, false ceilings, posts, staircases, safes, and storage racks). Outdoor structures, which can benefit, include: habitable-scale structures (such as playhouses, dog houses, cages, coops, beehives, barns, cabins, sheds, housing additions, tents, and telescope enclosures) additions to existing structures (e.g., overhangs; cooling and heating systems; outdoor audio and video mounts, racks, and stands; trellises and lattices; louvered shades; and lighting) sports equipment (e.g., basketball hoop mounts and stands; goals and nets; and practice equipment) temporary structures (tents, party houses, play structures) geodesic domes (i.e. "Bucky balls") of any size or scale, greenhouses, swimming pool structures (such as overhangs, diving stations, ladders, and storage), fencing and railings, planters, misters; playground equipment; temporary booths, ticket stands, food stands; etc. Other uses might include any framed object, from eyeglasses to automotive, aircraft, and spacecraft frames. This same system can also be used in a wide range of sizes, from nanostructures to toy construction sets, to enclosures for electronics, to scaffolding, to full-scale building projects.

A number of framing systems rely on cubes which are hollow or semi-hollow, allowing them to accept projections of various types in order to connect the cubes to framing materials. Such systems typically require that the cube have one or more faces that may not be used in connections, or that the connectors twist into place, rendering them incompatible with systems in which, for example, flat sheets of material are to be mated to the surface of the framing materials. Integral to this system is the fact that the connectors always meet the cube on only one face and are not required to be rotated into place.

Other framing systems rely on fasteners to attach framing members to their hubs. Such solutions complicate the process of assembly and disassembly. These additional elements also add weight to the structural joints and create more opportunities for mechanical failure.

Still other known framing systems incorporate methods, devices, and processes that require multiple people to assemble. The current invention addresses the need for a standardized system of parts which facilitate simple tool-less assembly and disassembly of framed structures, allowing for the creation of building kits which make it possible to readily reconfigure structures as needed, reusing the same parts again and again to achieve different structural ends.

BRIEF SUMMARY

The present invention provides an improved modular system for constructing frames, including an apparatus and method of assembling same. More specifically, the improved system allows structural members, whether hollow or solid, to be attached or decoupled in a direction perpendicular to the centerline of the members without having to move the members along their centerlines or to rotate them about their long axes. The improved structural system includes features and components that allow the structural members to be positioned at various angles. The system also enables curved members to be used. The system also allows for rotating, hinging, or otherwise mobile components. The present invention therefore provides a flexible, easy to use, sturdy system that can be used to construct a multitude of different frames of all sizes, from the very small to the very large.

This structural system can most easily be conceived of, in one preferred embodiment, as a hub formed from a cube comprising a solid core with a projection and flange on at least two faces, and at least one removable connector that couples to the cube. The cube includes a plurality of pairs of opposing, substantially flat faces. The most basic connector configuration comprises a body which contacts one of the faces of the cube hub and the back side of the flange; surrounds the flange on three sides; and contacts the outer face of the flange. The connector may be fixed to a structural member or to any other object by any number of means. The structural member can be of any number of forms or materials, including a beam, a rectangular or circular tube, a channeled form, a formed member, or an extruded member. Different types of structural members can be connected to different faces of the cube. Furthermore, one or more of the members connected to faces can be curved, angled, or modified with special purpose appendages or formed features. Still further, one or more of the connectors can be curved or angled so that a straight or curved structural member extends from the hub at a desired angle.

The structures of the present invention can be rectilinear or curvilinear and can have cross-bracing in multiple rectilinear and diagonal planes. The structural members or tubing may be of metal, wood, plastic, composite, or any other suitable material. The members may be of various sizes, from the very small to the very large, the dimensions of the cube hub and its projections scaling accordingly relative to the cross-section of the structural members. The connectors and structural members can be held together by any appropriate means (e.g., crimping, fasteners, integrated connector forms, or adhesives). The connectors may also be molded or machined integrally into the structural members (e.g., molded into plastic members or machined into metal members).

One primary advantage of the present invention, is that the component parts are interchangeable and can be used in myriad ways. For example, the connectors are configured and arranged, as is the cube hub, so that the connectors may be oriented on the hub in four rotational directions. In this embodiment, the cubical hub comprises six identical faces, each of which can accept any of the connector designs. This homogeneity of form facilitates tool-free assembly with a minimum of personnel and (importantly) instruction.

It is therefore an advantage of the present invention to provide a framing system that is easy to use.

Further, it is an advantage of the present invention to provide a framing system that does not require the end user to utilize tools or traditional fasteners.

Moreover, it is an advantage of the present invention to provide a framing system that is readily assembled and disassembled.

It is a further advantage of the present invention to provide a framing system that is adaptable to be made of many different types of materials.

Another advantage of the present invention is that it is adaptable to be realized in many different sizes, at many different scales.

It is still a further advantage of the present invention to provide a framing system that is sturdy.

Still further, it is an advantage of the present invention to provide a framing system that may be used to construct a variety of two dimensional, three dimensional, rectangular, angled, and curved frameworks.

It is another advantage of the present invention to provide a framing system the functioning of which (i.e., method of assembly and disassembly) is self-evident.

An important advantage of the present invention is that individual components can be reused and re-purposed in applications which are entirely unrelated to the original structure.

Additional features and advantages of the present invention are described in, and will be apparent from, the following Detailed Description of the Invention and the figures.

BRIEF DESCRIPTION OF THE DRAWING FIGURES

Figure 3:
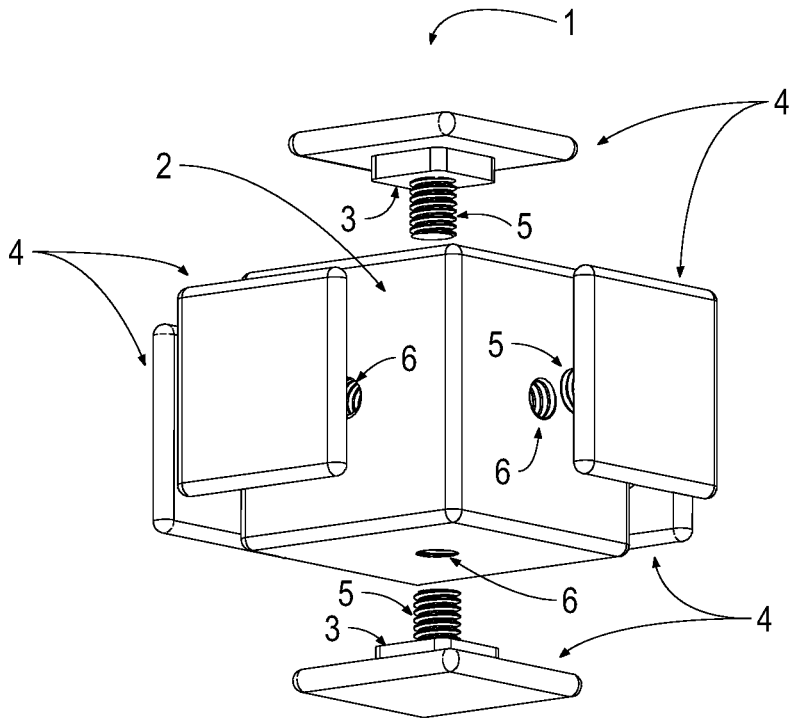

FIG. 3 presents a perspective view of an alternative separate embodiment of the hub 1.

Figure 4:
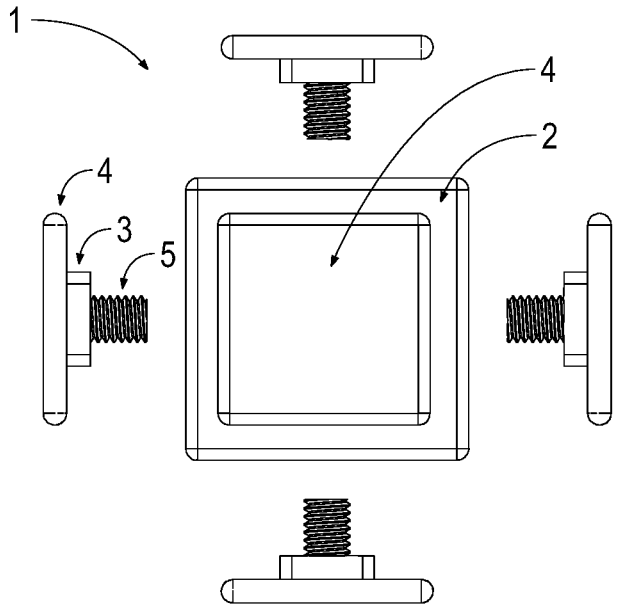

FIG. 4 illustrates an alternative separate embodiment of the hub 1 in its identical top, bottom, left, right, front, and back views (all sides are identical) of the symmetrical configuration.

Figure 5:
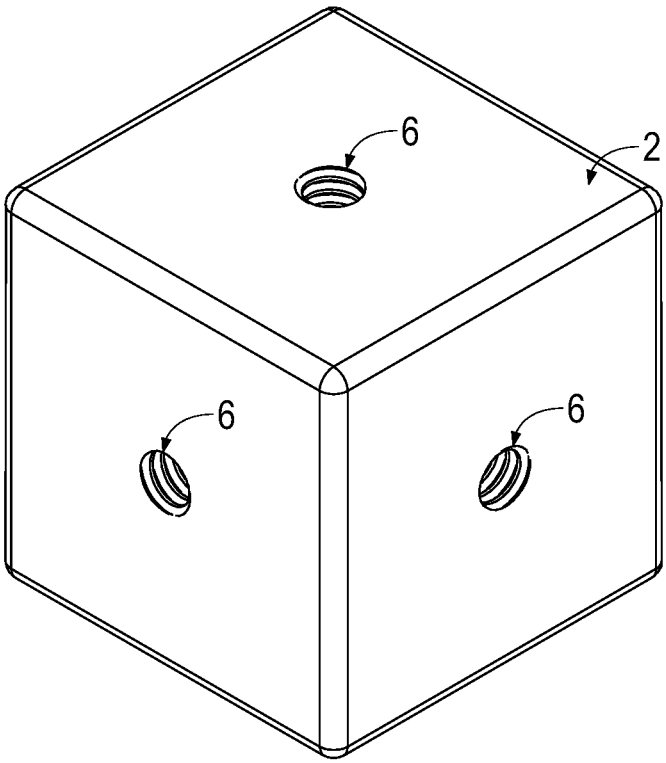

FIG. 5 presents a perspective view of an alternative separate embodiment of the hub core 2.

Figure 6:
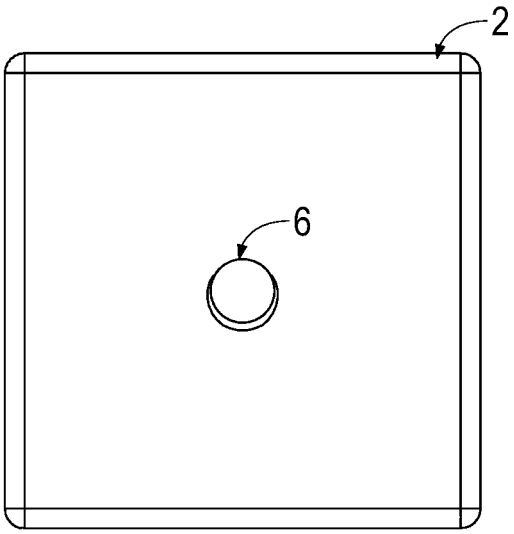

FIG. 6 illustrates the hub core 2 of an alternative separate embodiment from top, bottom, left, right, front, and back views (all sides are identical) of the symmetrical configuration.

Figure 7:
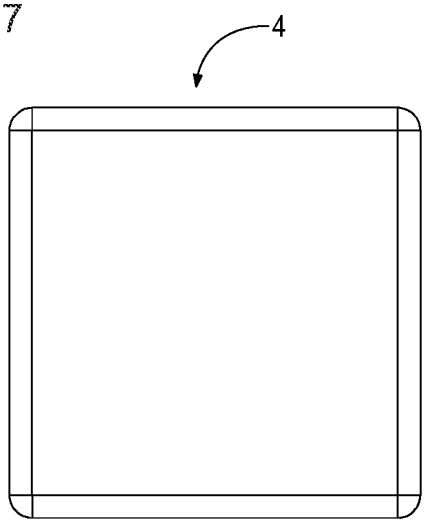

FIG. 7 illustrates this particular separate embodiment of the flange 4 from a top view.

Figure 8:
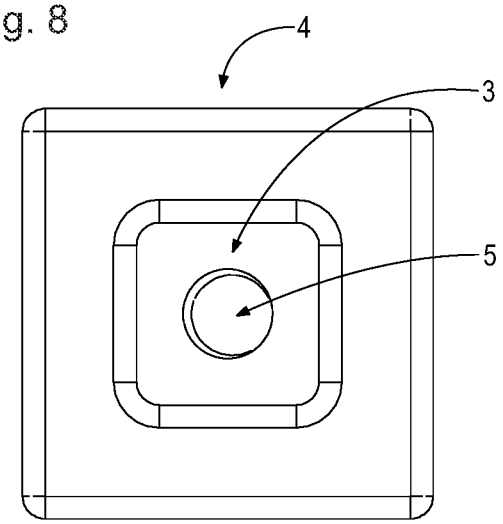

FIG. 8 shows this particular separate embodiment of the flange 4 from a bottom view.

Figure 9:
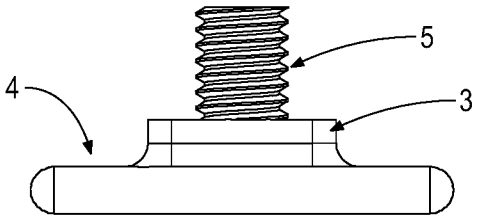

FIG. 9 illustrates this particular, separate configuration of the flange 4 from front, back, left, and right views, which are identical in this symmetrical component.

Figure 10:
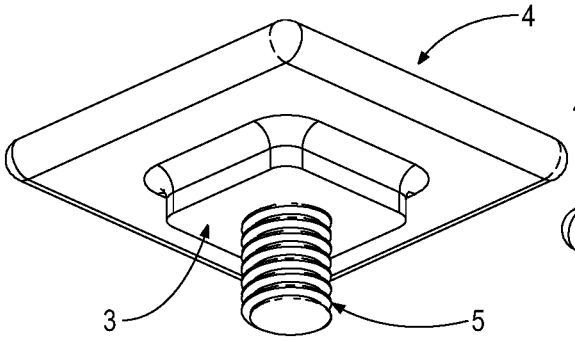

FIG. 10 shows this particular separate embodiment of the flange 4 from a perspective view.

Figure 11:
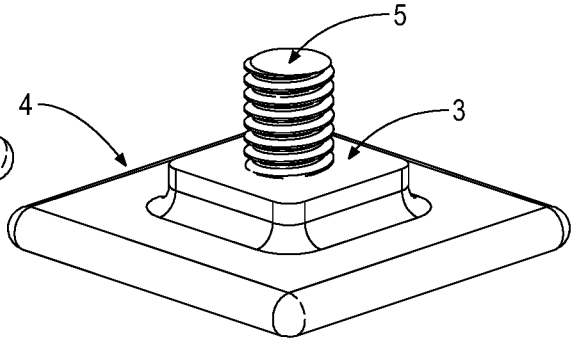

FIG. 11 illustrates this particular separate embodiment of the flange 4 from an iso view.

Figure 12:
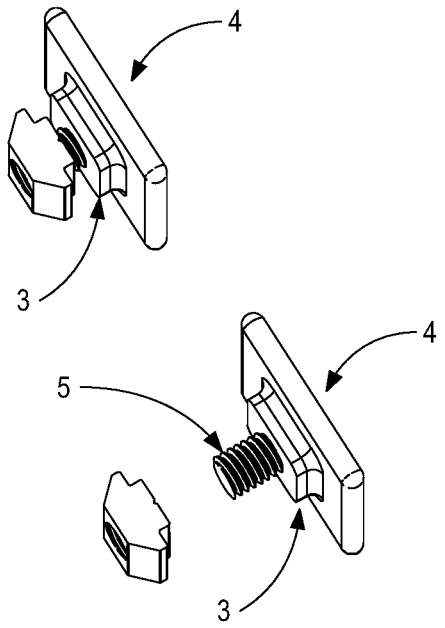
Figure 13:
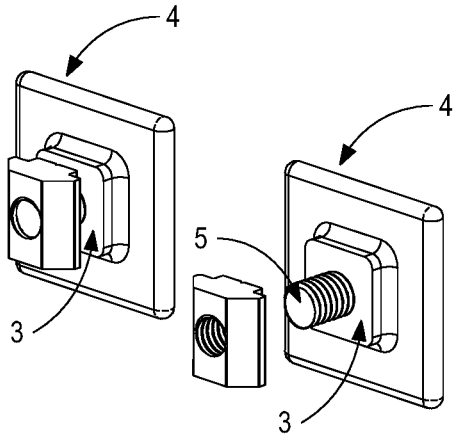

FIGS. 12 and 13 present flange 4 with its integral projection 3 and threaded appendage 5, which in this configuration screws into the tapped hole of a common T-slot nut such as those used in extruded aluminum framing members. The assembled (left) and exploded (right) assemblies are shown from perspective and iso views.

Figure 14:
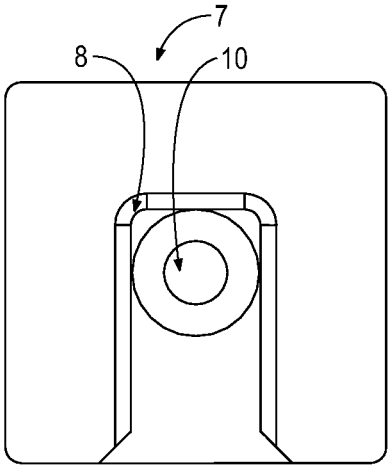
Figure 15:
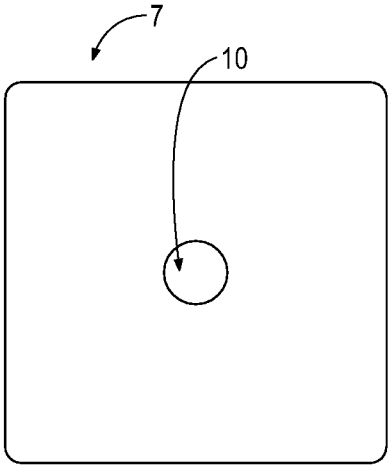
Figure 16:
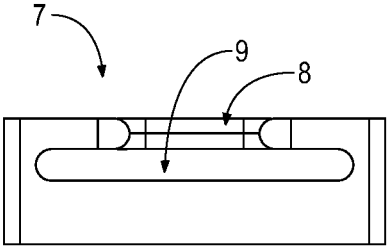

FIGS. 14-16 illustrate the most fundamental form of a connector 7 from top, bottom, and front views, respectively.

Figure 17:
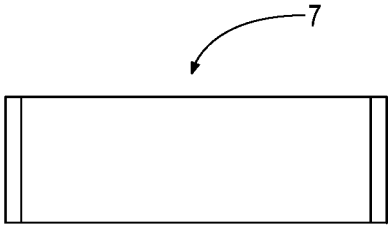

FIG. 17 shows the most fundamental form of a connector 7 from back, left, and right views, all of which are identical.

Figure 18:
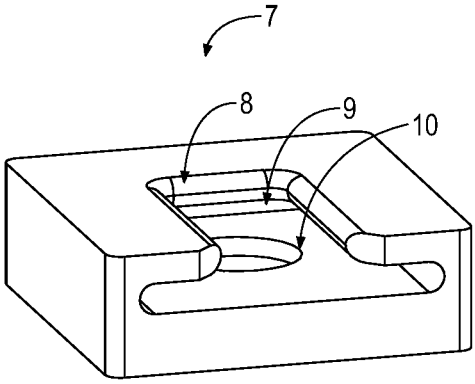
Figure 19:
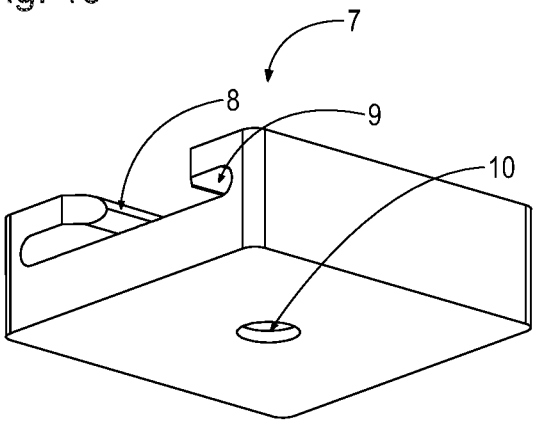

FIGS. 18 and 19 illustrate the most fundamental form of a connector 7 from perspective and iso views, respectively.

Figure 20:
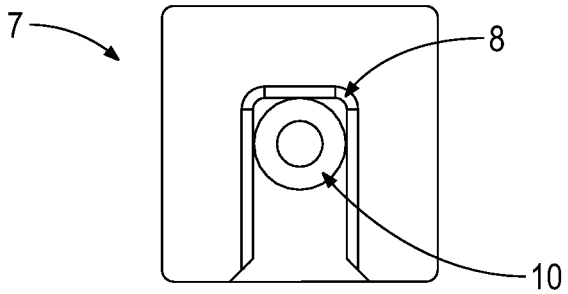
Figure 21:
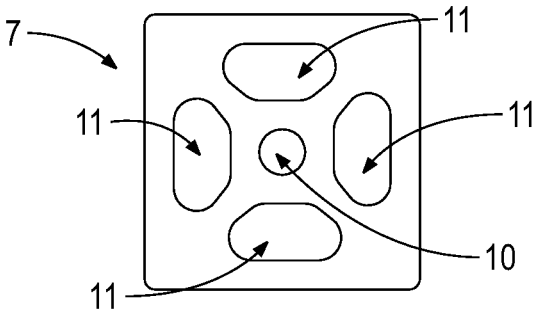
Figure 22:
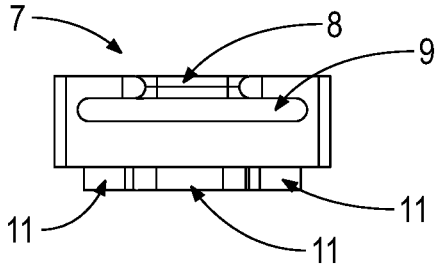

FIGS. 20-22 show the connector 7, as modified for use with T-track extrusions, from top, bottom, and front views, respectively.

Figure 23:
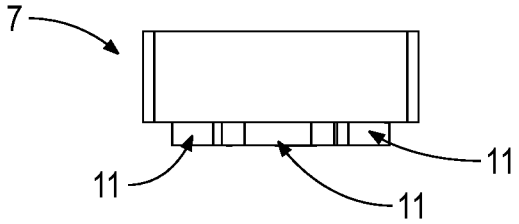

FIG. 23 presents the connector 7, as modified for use with T-track extrusions, from back, left, and right views, which are identical.

Figure 24:
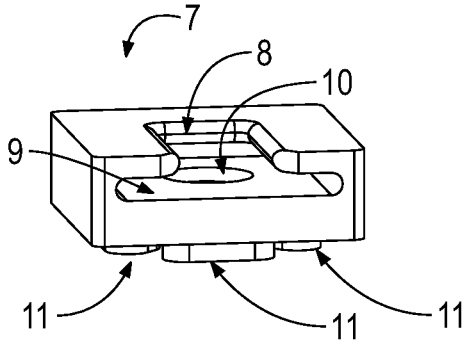
Figure 25:
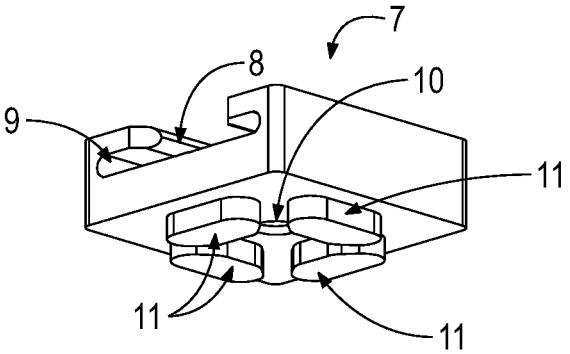
Figure 26:
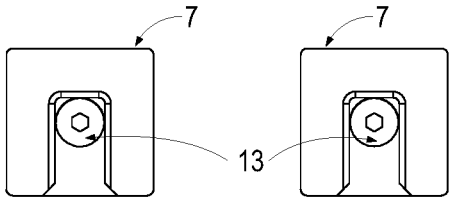
Figure 27:
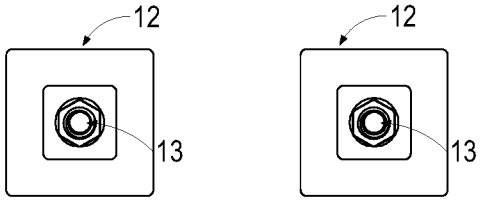
Figure 28:
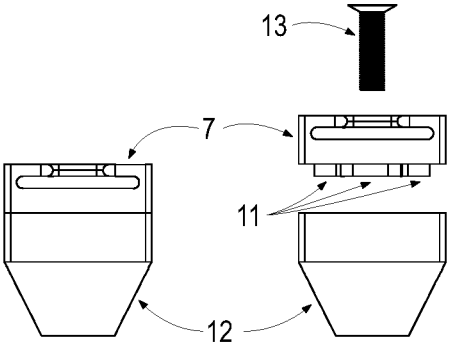
Figure 29:
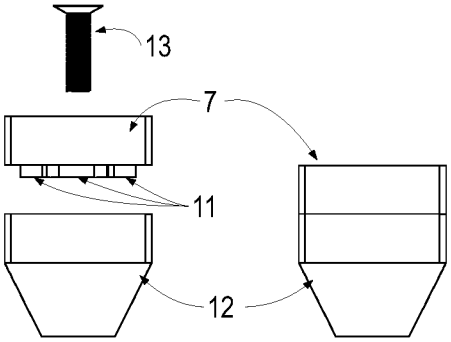
Figure 30:
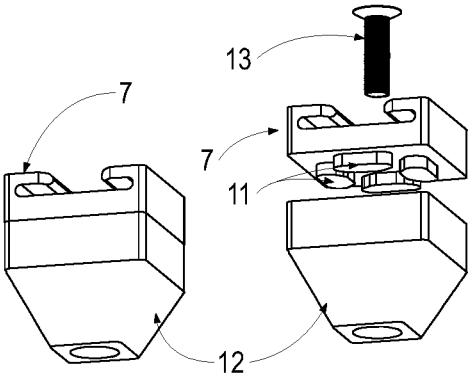
Figure 31:
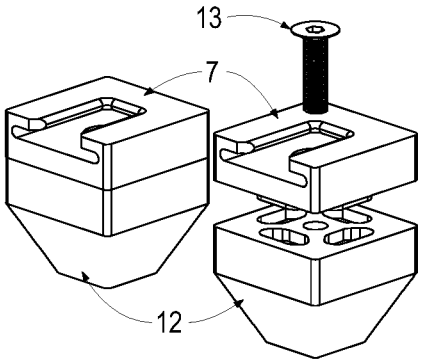

FIGS. 24 and 25 illustrate the connector 7, as modified for use with T-track extrusions, from perspective, and iso views, respectively.

FIGS. 26-31 show the connector 7 attached to a purpose-built rubber foot in an assembled state (left) and exploded (right) from top, bottom, front, back, perspective, and iso views, respectively.

Figure 32:
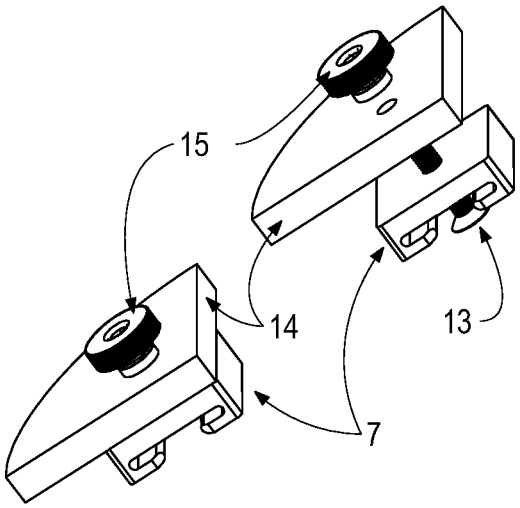
Figure 33:
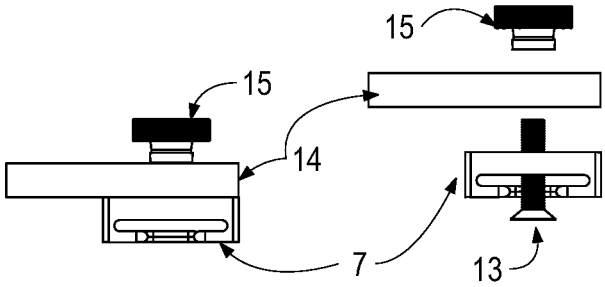
Figure 34:
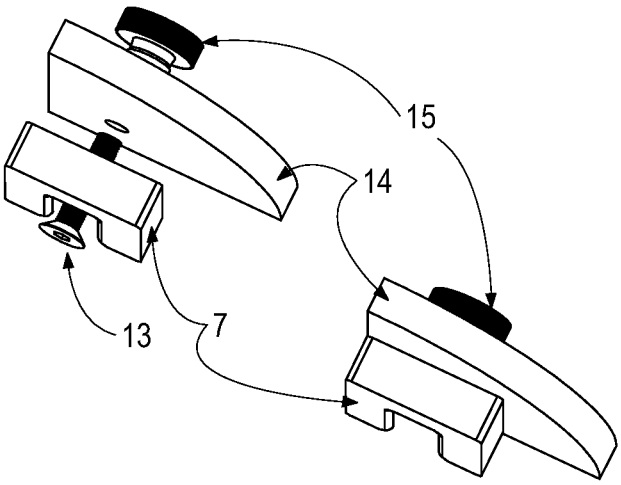

FIGS. 32-34 illustrate a connector 7 utilized as an anchor, suitable for mounting and supporting panels, from perspective, bottom, and iso views, respectively.

FIGS. 35-42 show an angle body 16 from top, bottom, front, back, left, right, perspective, and iso views, respectively.

FIGS. 43-50 illustrate an angle body 16 with an attached shaft 21. The assembly is shown from top, bottom, front, back, left, right, perspective, and iso views, respectively.

FIGS. 51-56 illustrate an angle assembly 24 from front, back, left, right, perspective, and iso views, respectively.

FIGS. 57-64 show an angle assembly 24 with an attached flange 4 and connector 7 from top, bottom, front, back, left, right, perspective, and iso views, respectively.

FIGS. 65-72 illustrate an angle assembly 24 with two attached flanges 4 from top, bottom, front, back, left, right, perspective, and iso views, respectively.

FIGS. 73-80 show an angle assembly 24 with four attached flanges 4 from top, bottom, front, back, left, right, perspective, and iso views, respectively.

FIGS. 81-88 show an angle assembly 24 with two attached connectors 7 from top, bottom, front, back, left, right, perspective, and iso views, respectively.

Figure 89:
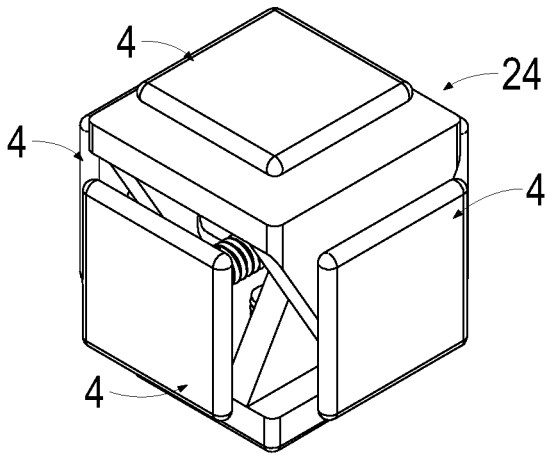
Figure 90:
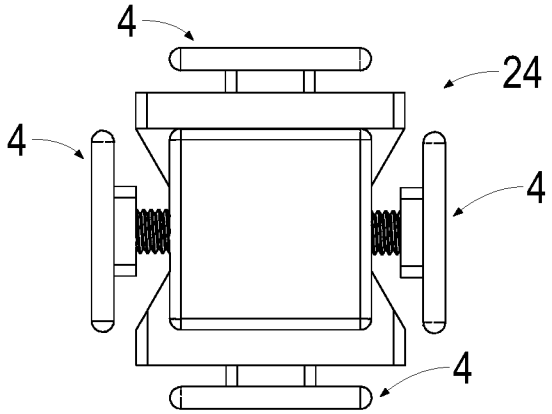
Figure 91:
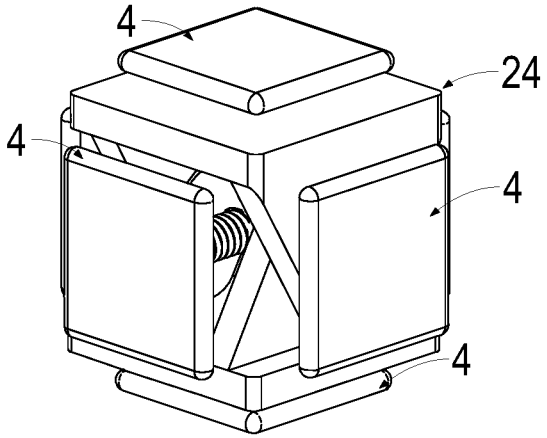

FIGS. 89-91 show an angle assembly 24 with six attached flanges 4 from perspective, side, and iso views, respectively.

Figure 92:
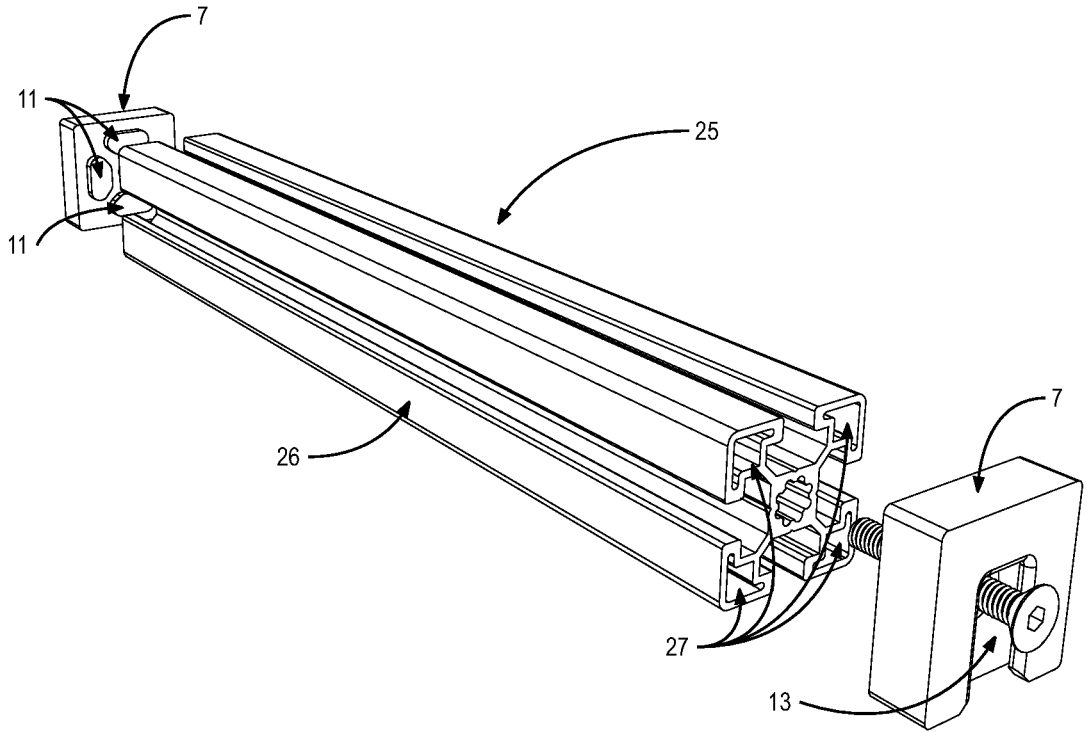

FIG. 92 illustrates a structural member assembly 25, exploded, from a perspective view.

Figure 93:
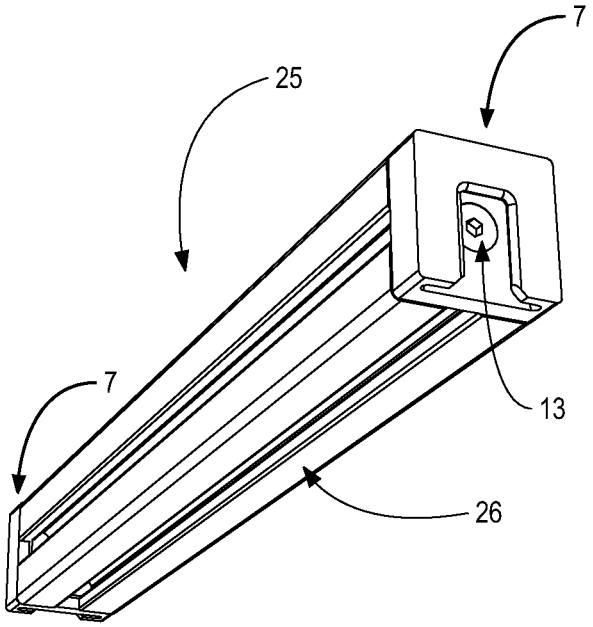

FIG. 93 illustrates a structural member assembly 25, assembled, from an iso view.

Figure 94:
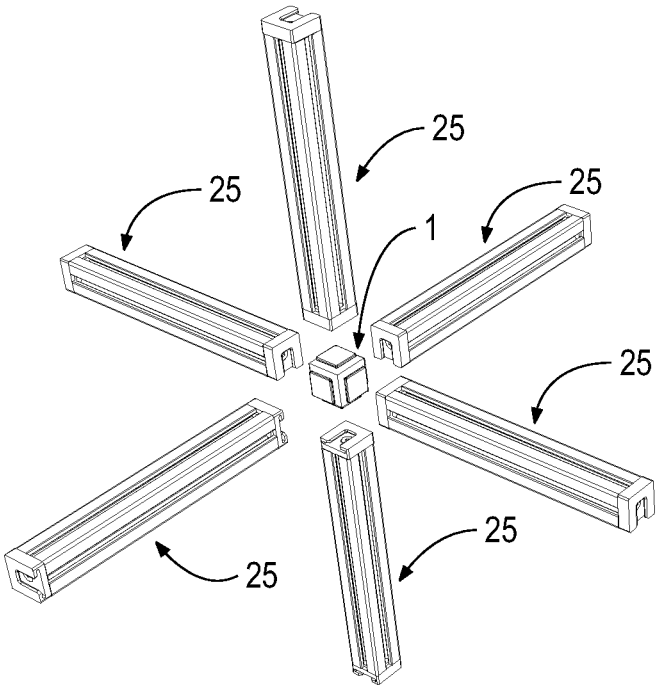
Figure 95:
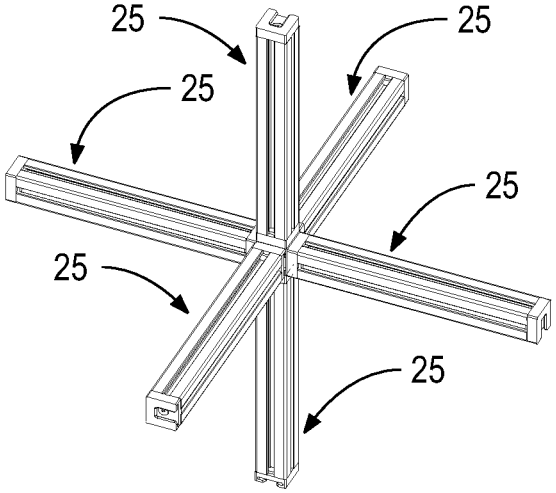

FIGS. 94 and 95 offer, respectively, exploded and assembled perspective views of structural member assemblies 25 attached to all 6 facets of a hub 1.

Figure 96:
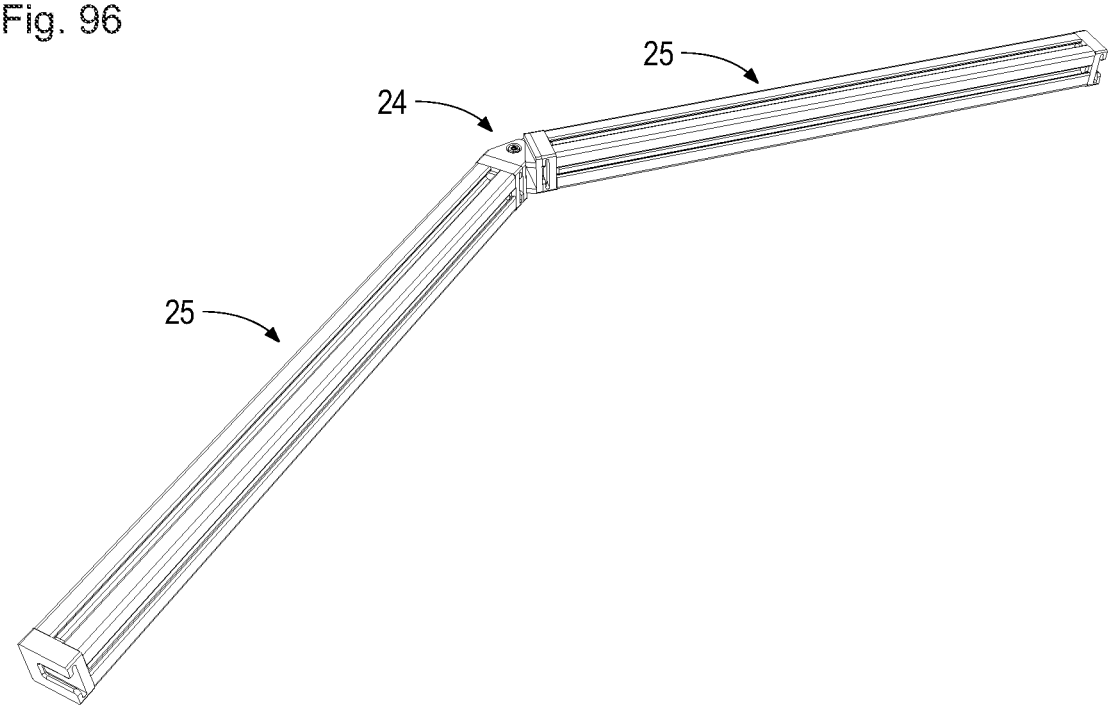
Figure 97:
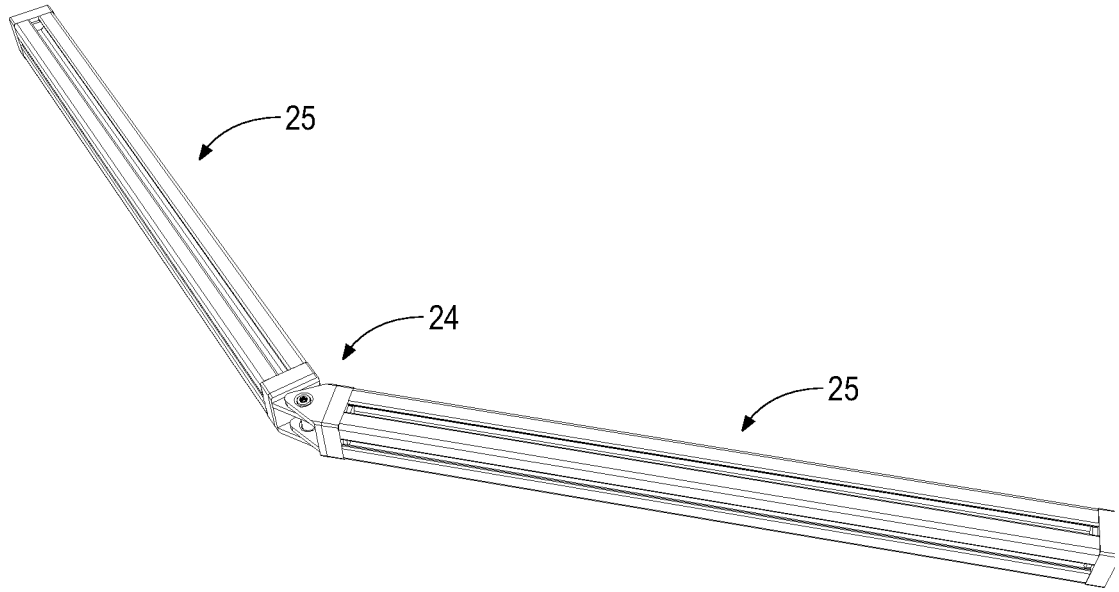

FIGS. 96 and 97 display perspective and iso views respectively of structural member assemblies 25 as attached to an angle assembly 24.

Figure 98:
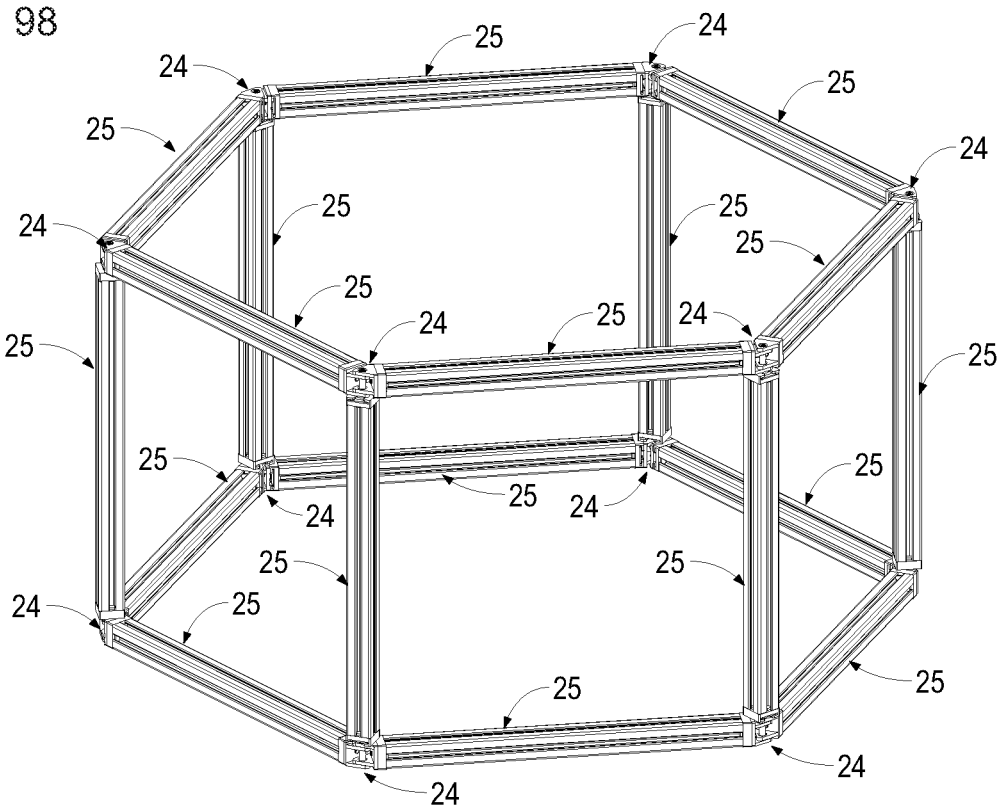
Figure 99:
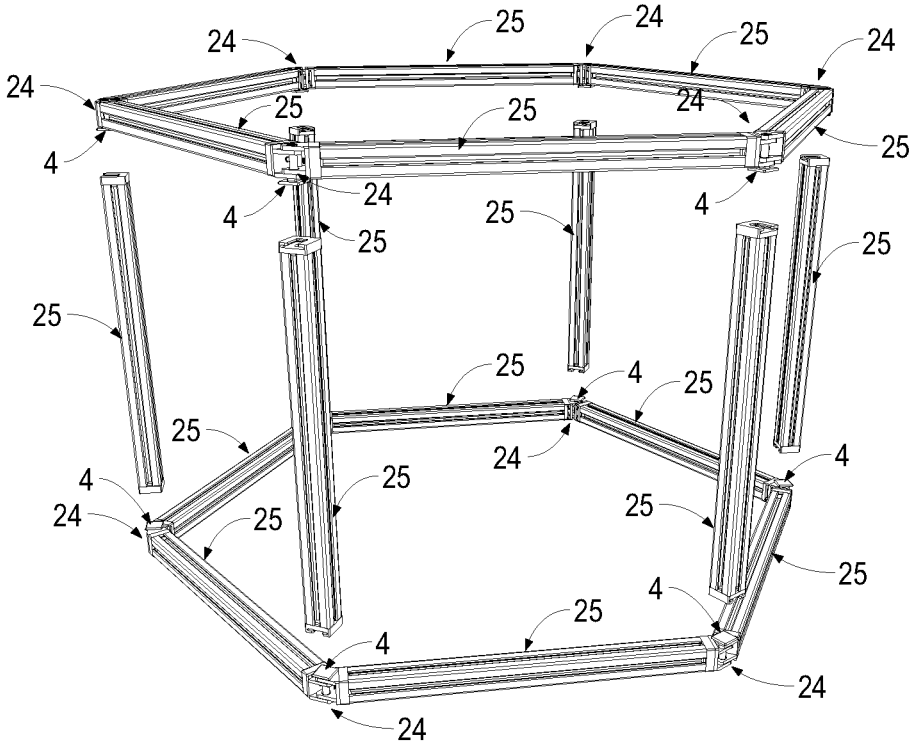

FIGS. 98 and 99 show a 3-dimensional, hexagonal structure built with the system in perspective and exploded views, respectively.

Figure 100:
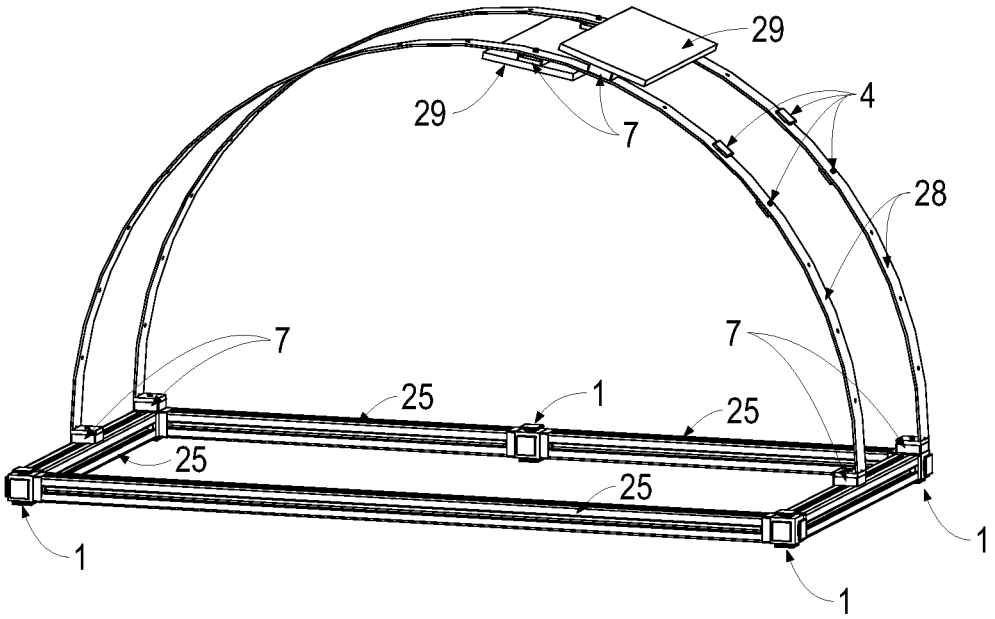
Figure 101:
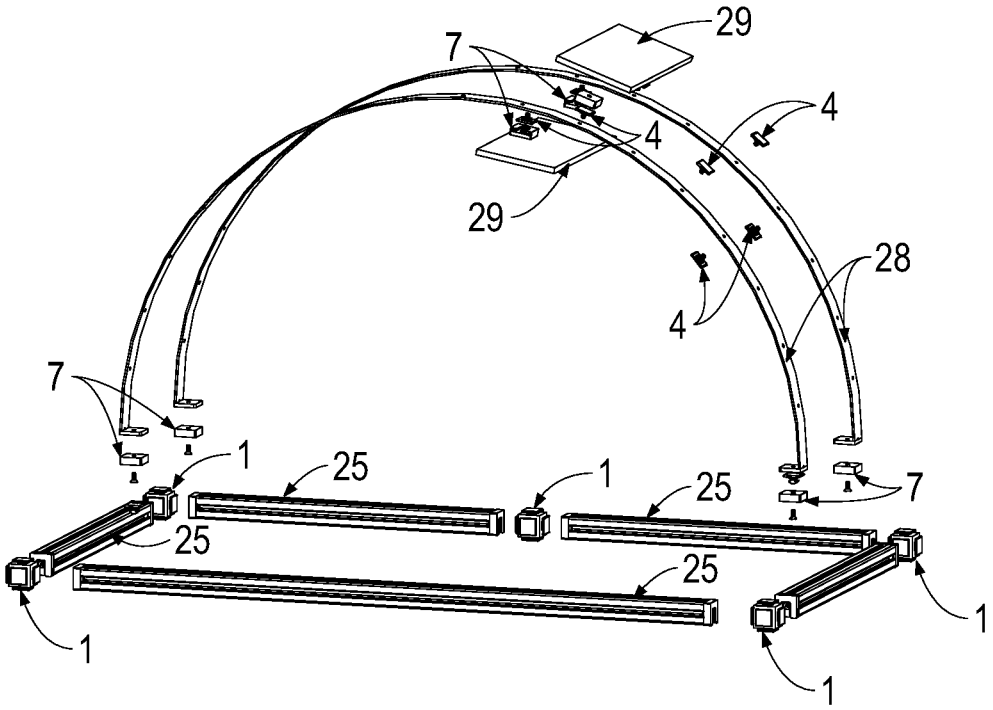

FIGS. 100 and 101 show a curved structure assembled via the system in perspective and exploded views, respectively.

Figure 102:
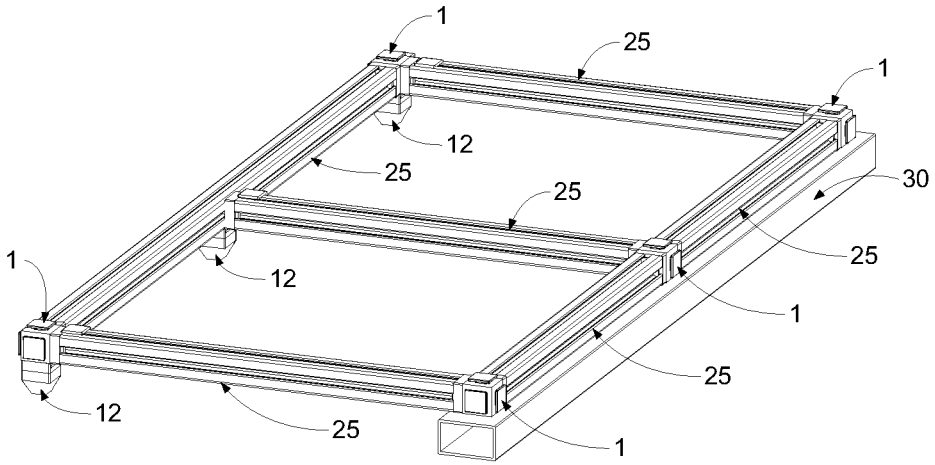
Figure 103:
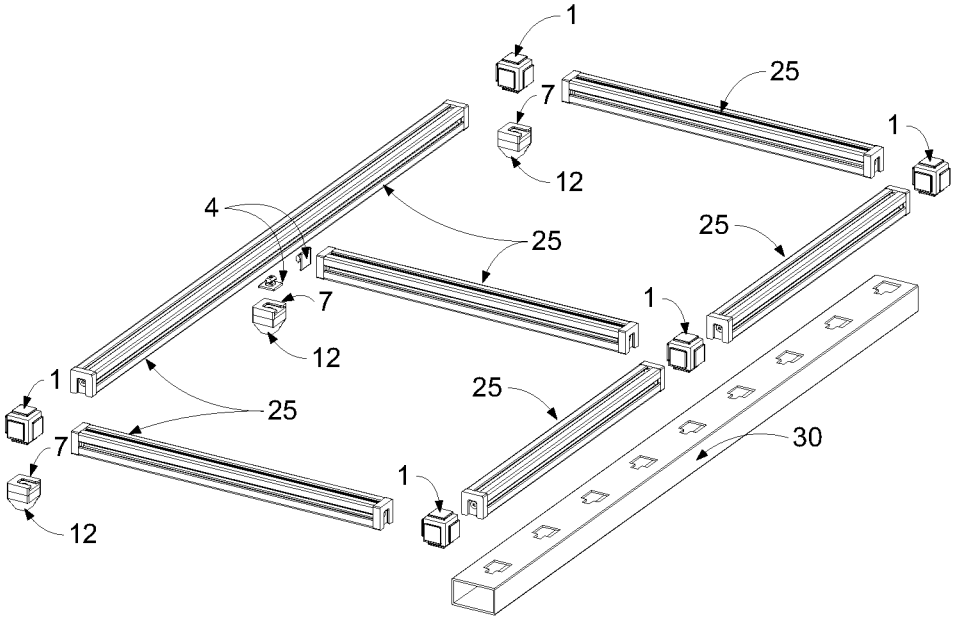

FIGS. 102 and 103 illustrate a base structure in perspective and exploded views, respectively.

Figure 104:
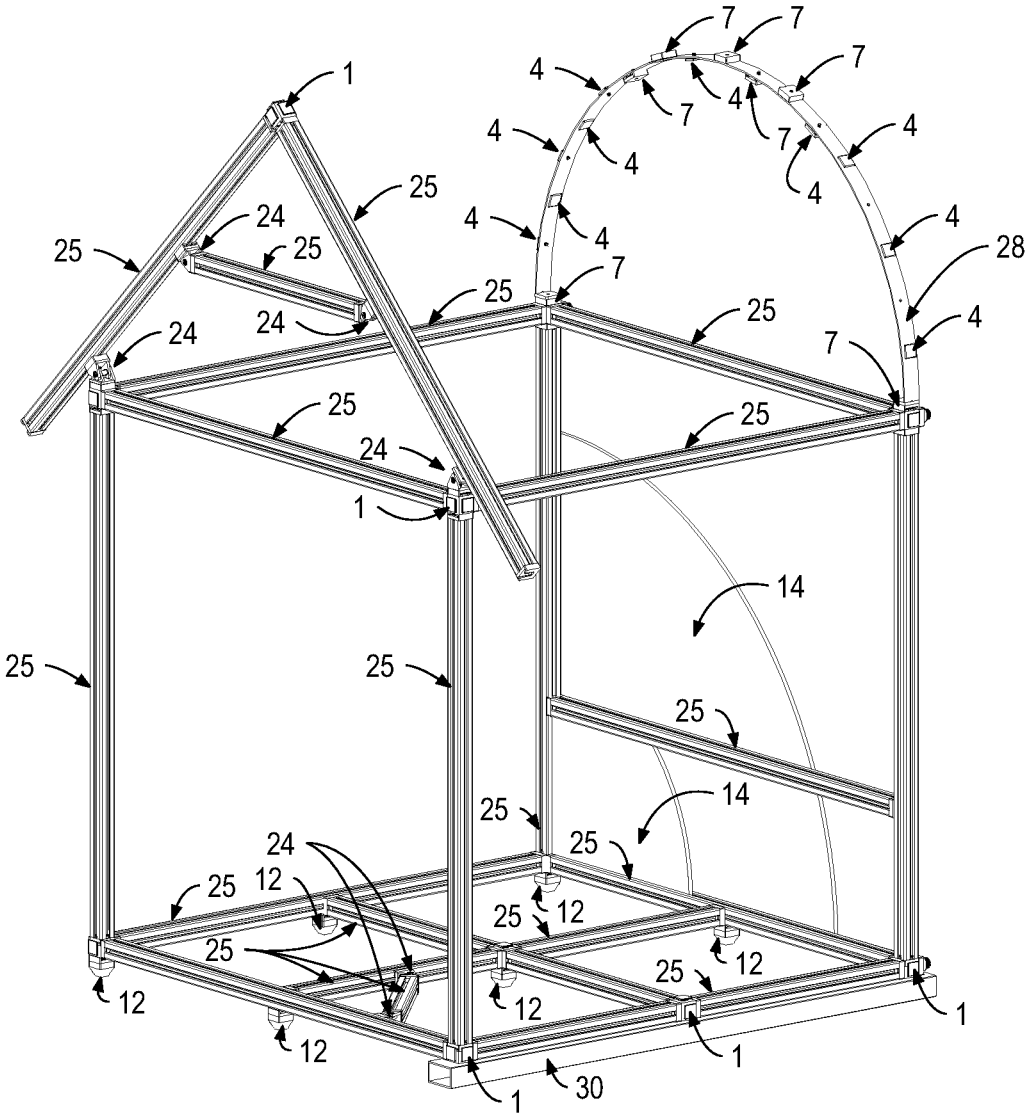
Figure 105:
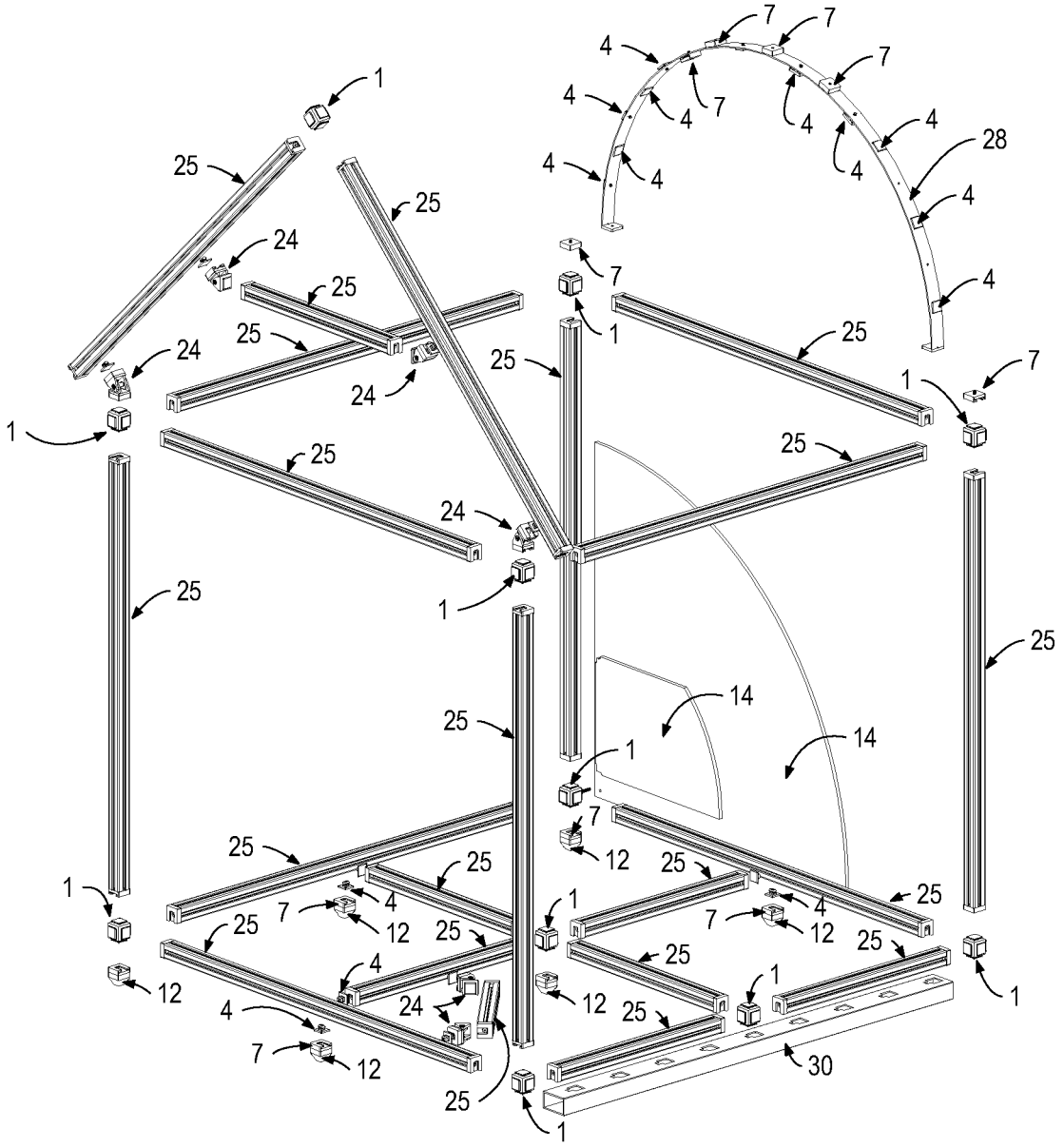

FIGS. 104 and 105 show a simple framed structure, built via the system described herein, in perspective and exploded views, respectively.

DETAILED DESCRIPTION OF PREFERRED EXEMPLARY EMBODIMENTS

Figure 1:
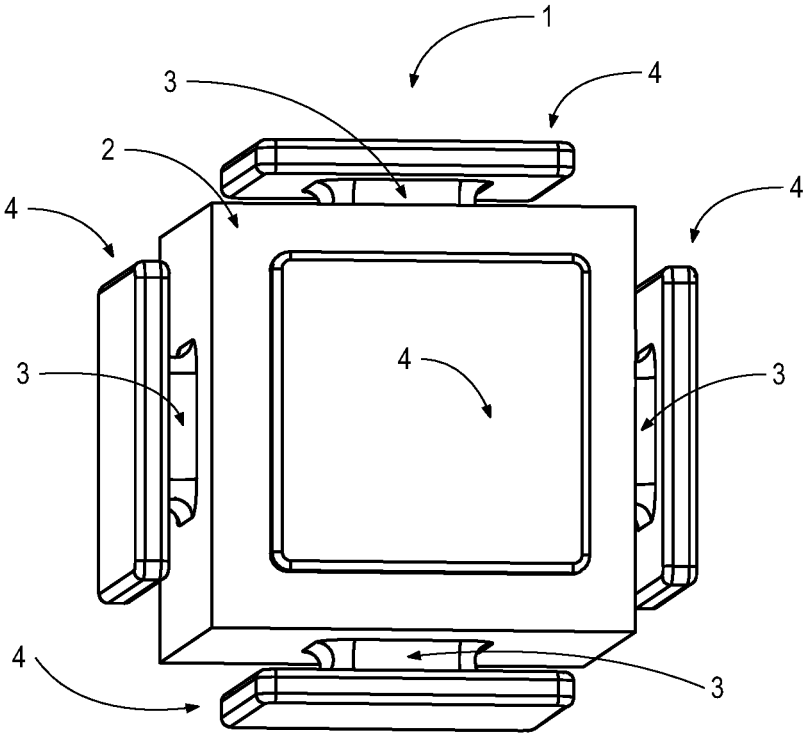
FIG. 1 is a perspective view of the hub 1 of the present invention.
Figure 2:
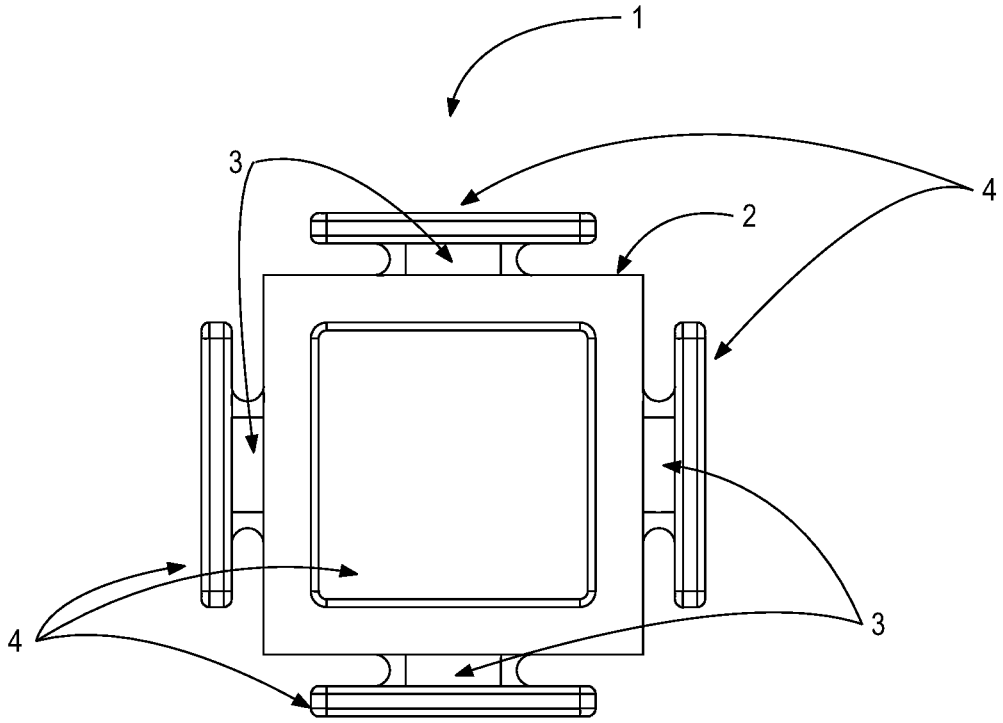
FIG. 2 illustrates the identical top, bottom, front, back, left, and right views of the hub 1, as all six sides of the hub are identical.

Referring now to the drawings and in particular to FIGS. 1-2, the core component that connects any two or more structural members or other bodies of the framing system described herein, is the hub 1. The hub 1 comprises six substantially flat faces, each of which can embody, or have appended to it, a minimum of one projection 3 and flange 4, which can in turn receive the various connectors described below. In one preferred embodiment, the hub 1's core 2 is of a cubical shape.

The hubs 1 may be made of any number of metals, plastics, rubbers, composites, or any other material deemed appropriate to a given purpose, scale, and structure. The hub 1 may be executed at any scale that is possible to realize for such a body, from the very small to the very large.

Importantly, the scale of the projections 3 and flanges 4 relative to the core 2 may vary according to the given materials, purpose, and arrangement of a given structure.

As illustrated in FIGS. 3-13, in another preferred embodiment, the hub 1 can also be realized as a set of individual connectible parts, with the hub 1 comprising one core 2 and at least one flange 4 with its integral projection 3 and threaded shaft 5. The assembly illustrated in FIGS. 3 and 4 relies upon tapped holes 6 in the hub core 2 to mate with the threaded projections 5 on the individual flanges 4. This embodiment allows for hubs to be affixed with as many or as few projections (of which the flange 4 is but one preferred example) as desired, and for the projections to be attached to other points in a given structure, facilitating myriad possibilities for construction, accessorizing, aesthetic adornment, etc. Note, too, that the flared portion of an independent embodiment of flange 4, with its threaded projection 5, allows the flanges to be mounted or removed without the use of tools.

One such example, shown in FIGS. 12-13, mates a flange 4 with a common T-slot nut in order for the flange 4 to attach directly to extruded aluminum framing members with integral T-slots. This configuration is but one example of many possible interfaces between the system described herein and existing structural elements.

Referring now to FIGS. 14-19, the most fundamental form of a connector 7 is illustrated. A connector of this system can be slidably positioned to mate with a hub 1, a flange 4 and projection 3, on any of its six faces, from any of four directions. The most salient structural features of the connector 7 are shown: a c-shaped slot 8 which allows the projection 3 of a flange 4 to mate with the connector 7; a cavity 9 which allows the flange 4 to mate with the connector 7; and a hole 10 which allows for a fastener (for example, the countersink screws illustrated throughout the drawings) to join the connector 7 with a framing member. It should be noted that this embodiment of the connector is but one of a nearly infinite number of interfaces between a hub and a structural member. Connectors may comprise a multitude of forms embodying myriad means of adapting to hubs, structural members, and any number of external forms and surfaces.

Illustrated in FIGS. 20-25 is but one example of additional bodies 11 machined into, molded, or otherwise appended to the bottom face of a connector 7. In this case, the additional bodies 11 allow the connector 7 to fit within the T-slot channels 27 (FIG. 92) further fixing the connectors to the structural members and preventing the connectors from rotating along the structural members' long axes. As noted above, myriad other embodiments of connector 7 are possible, allowing for the optimized mating of connectors 7 with various framing members, devices, forms, surfaces, etc.

In addition to facilitating stronger mating with framing members, bodies integrated into the bottom of connectors 7 can also be used to form bonds with other bodies in order to meet additional functional requirements. FIGS. 26-31 illustrate but one of a plethora of possibilities, in this case attaching to the feet 12 that appear in later figures. Other embodiments might include a nearly limitless number of possible forms, for example: bodies which are shaped to conform to curved surfaces, allowing for the latter to attach to a framed structure; forms which facilitate the attachment of functional or decorative elements to a framed structure; means of adapting framed structures to a given site; etc.

The versatility of the system described herein is further demonstrated in FIGS. 32-34, where a connector 7 is attached to a panel 14 via a bolt 13 and secured by a knurled nut 15 which may be tightened by hand, obviating any need for tools, as is a feature of the system broadly. So comprised, this system affords the opportunity to hang panels from the framed structure, creating enclosed spaces.

Figure 35:
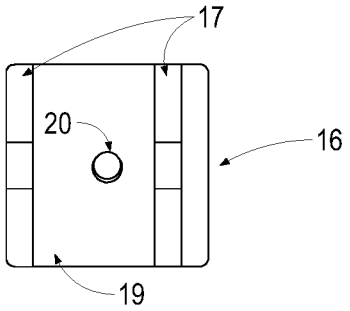
Figure 36:
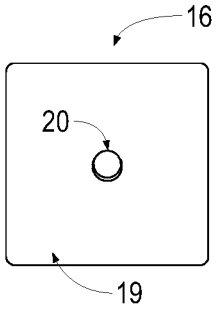
Figure 37:
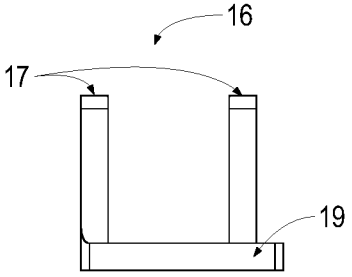
Figure 38:
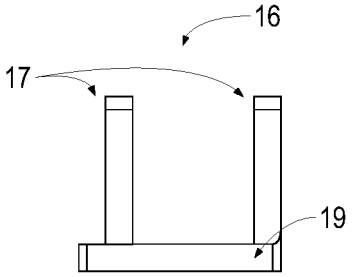
Figure 39:
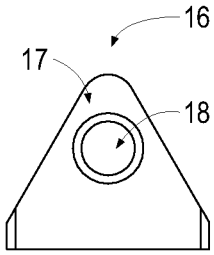
Figure 40:
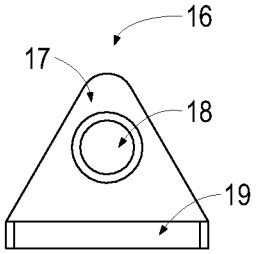
Figure 41:
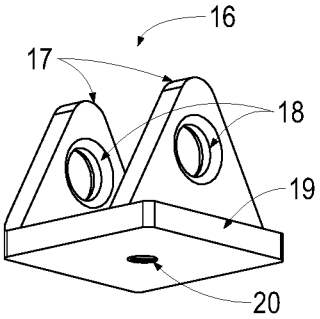
Figure 42:
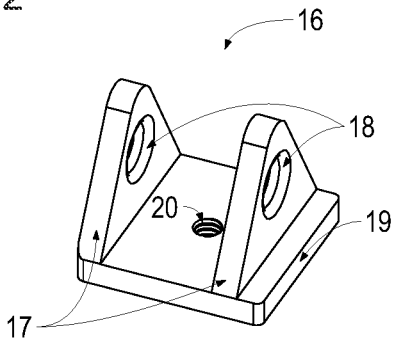
Figure 43:
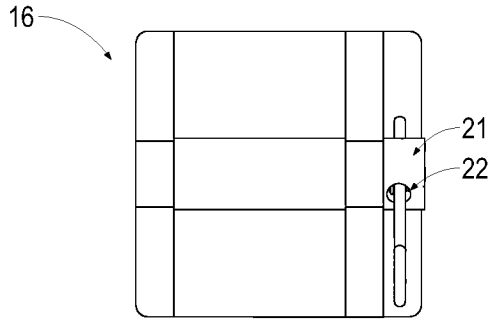
Figure 44:
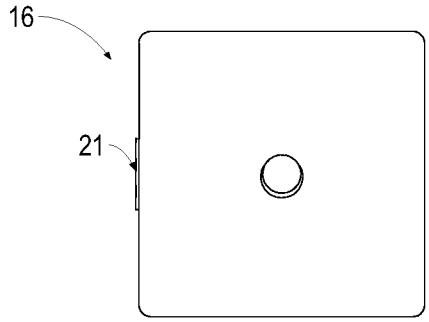
Figure 45:
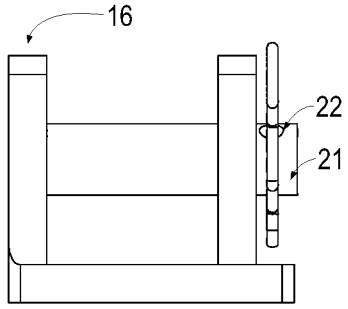
Figure 46:
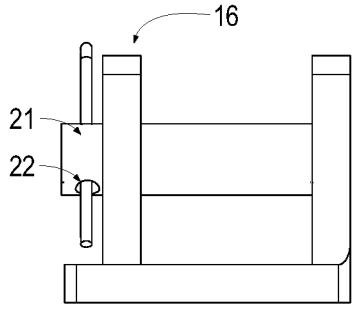
Figure 47:
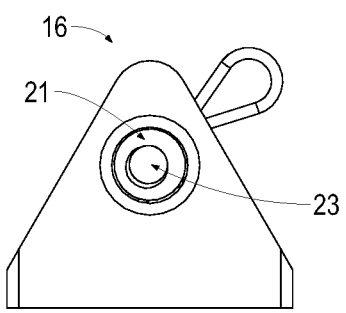
Figure 48:
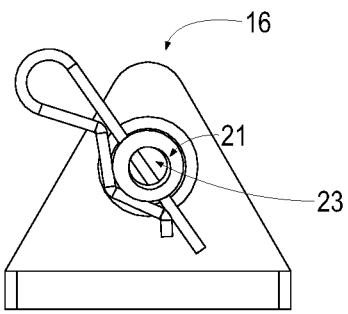
Figure 49:
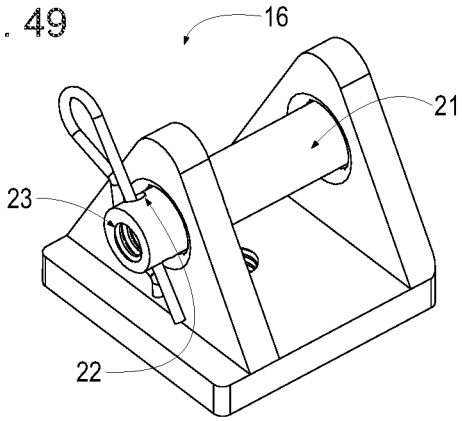
Figure 50:
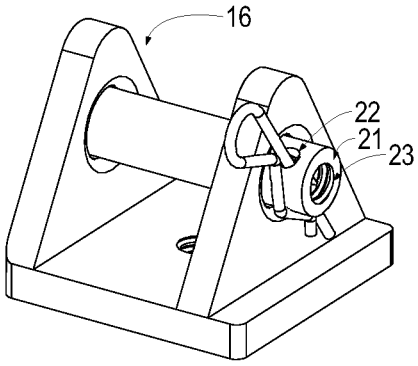
Figure 51:
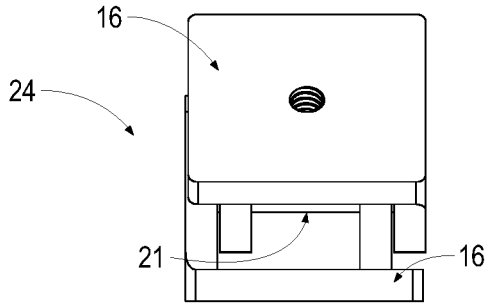
Figure 52:
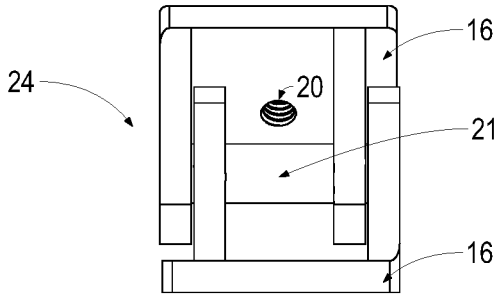
Figure 53:
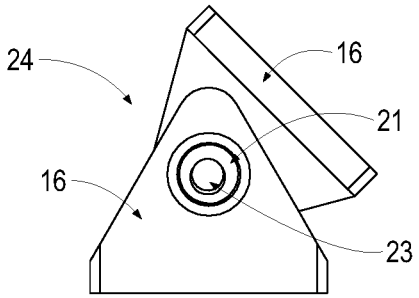
Figure 54:
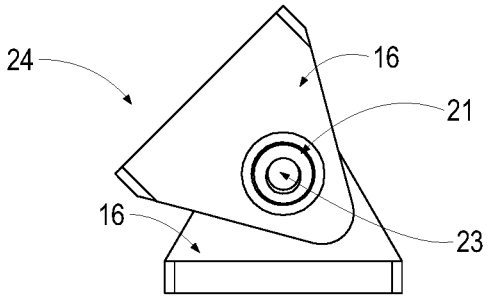
Figure 55:
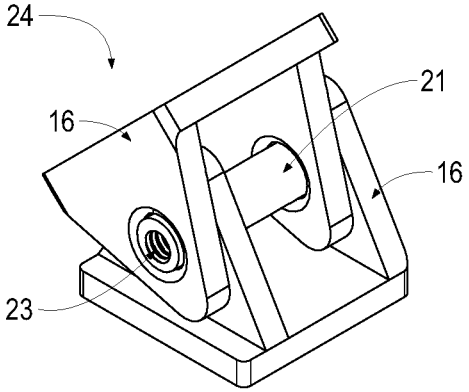
Figure 56:
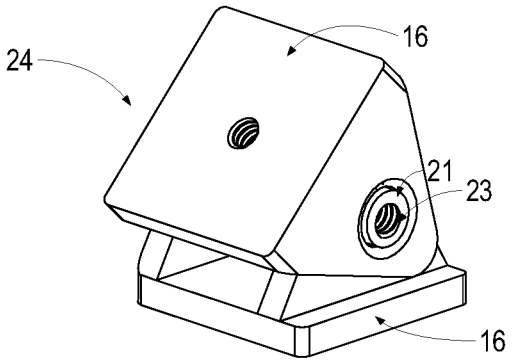
Figure 57:
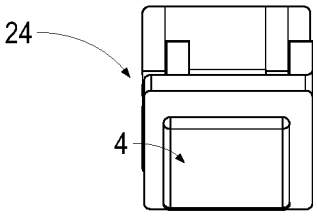
Figure 58:
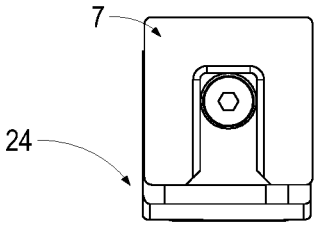
Figure 59:
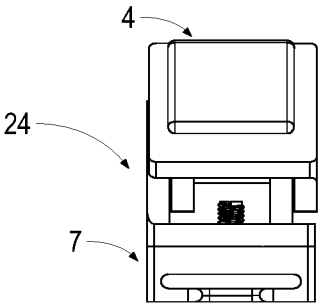
Figure 60:
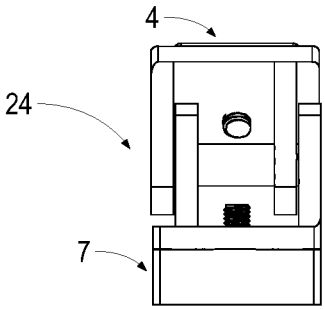
Figure 61:
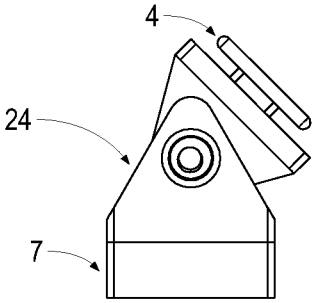
Figure 62:
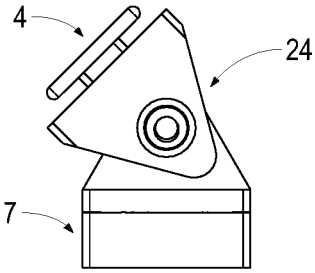
Figure 63:
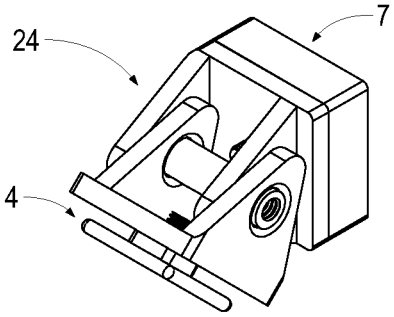
Figure 64:
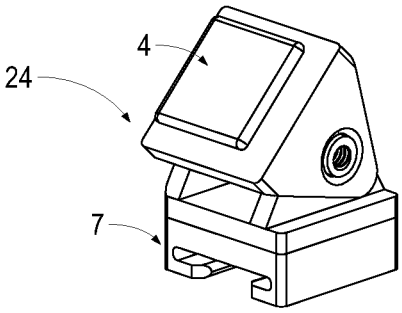
Figure 65:
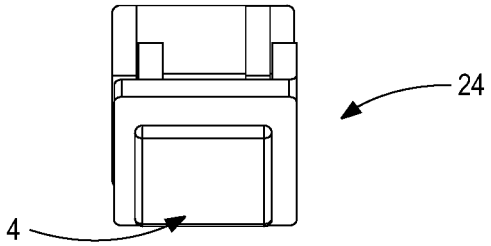
Figure 66:
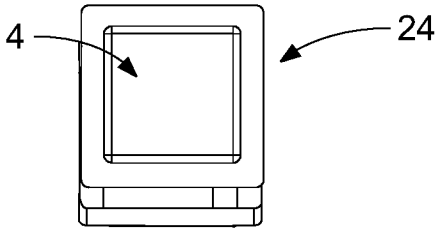
Figure 67:
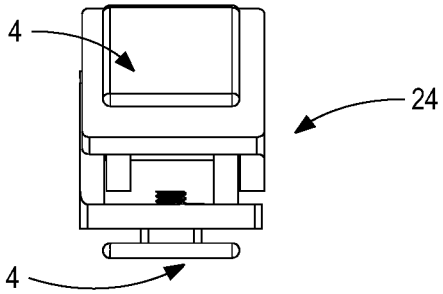
Figure 68:
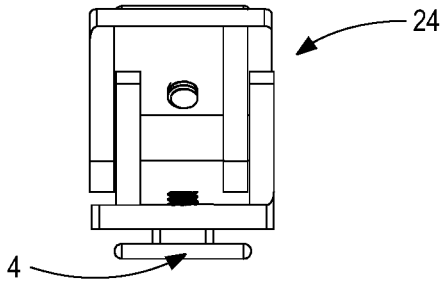
Figure 69:
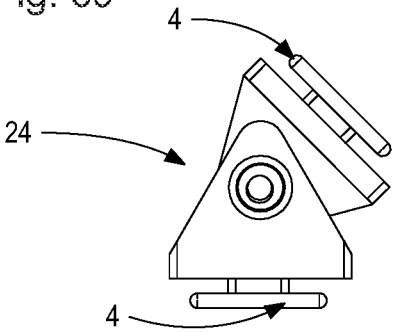
Figure 70:
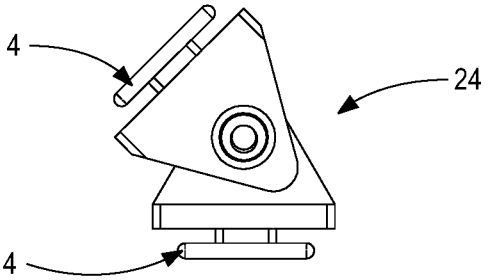
Figure 71:
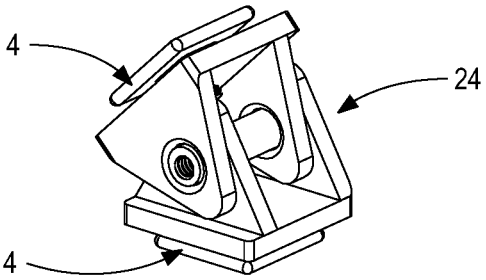
Figure 72:
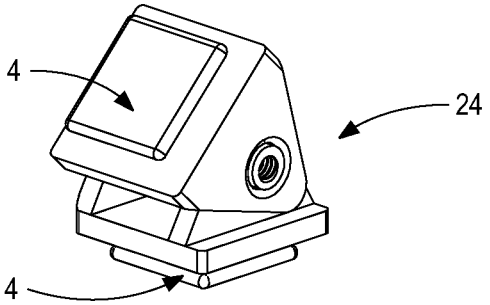
Figure 73:
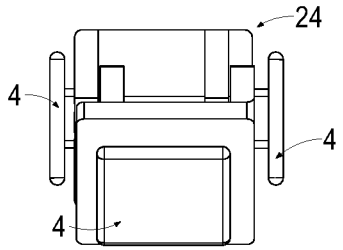
Figure 74:
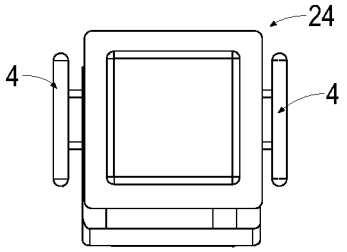
Figure 75:
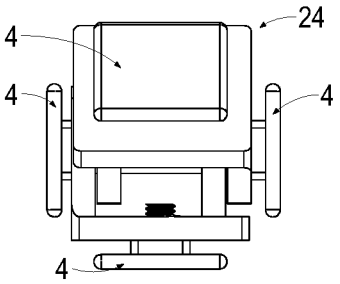
Figure 76:
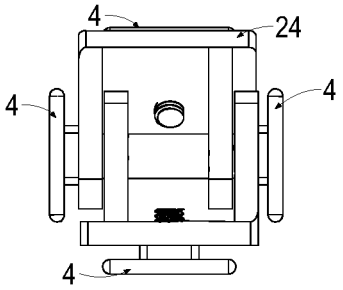
Figure 77:
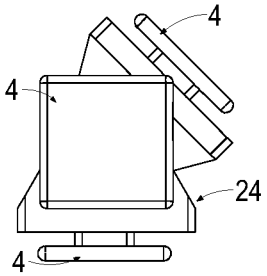
Figure 78:
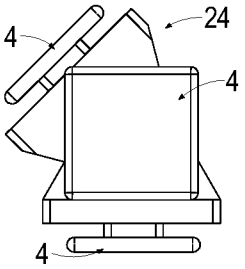
Figure 79:
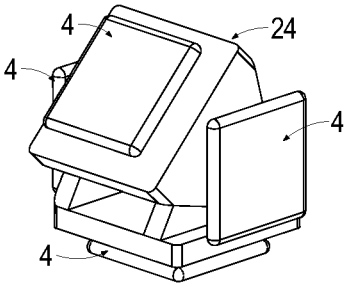
Figure 80:
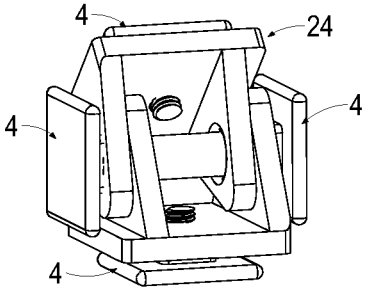
Figure 81:
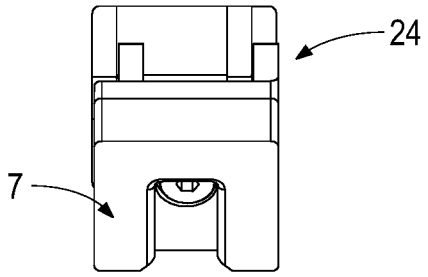
Figure 82:
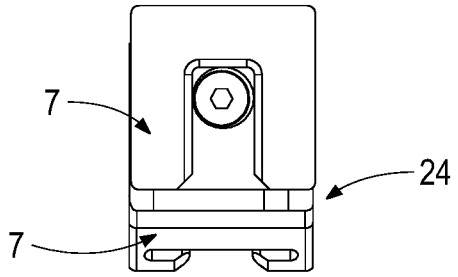
Figure 83:
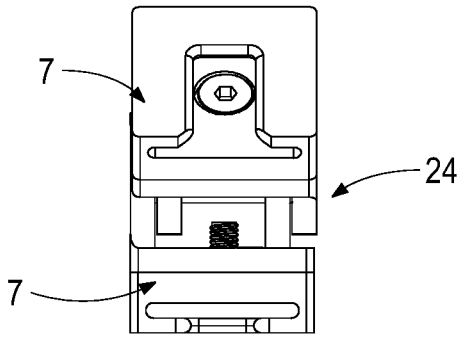
Figure 84:
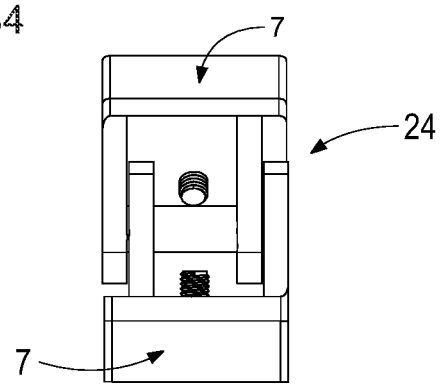
Figure 85:
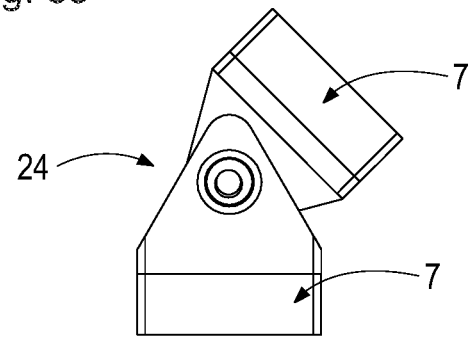
Figure 86:
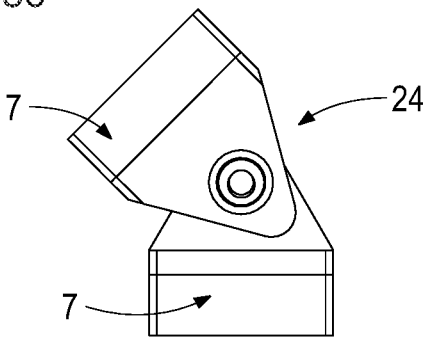
Figure 87:
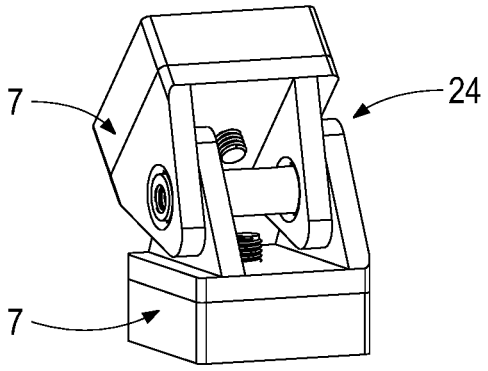
Figure 88:
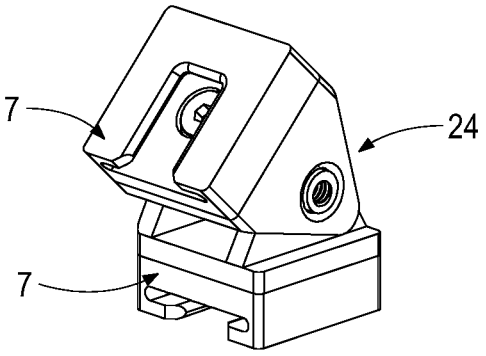

Another example of the system's adaptable nature can be seen in FIGS. 35-91, where a variety of frame construction functions are facilitated by a plurality of parts constructed using the flanges 4 and connectors 7 already described, with the addition of just two more components: the angle body 16 and the shaft 21. Important to this invention, as noted above, is the interchangeable nature of its components.

For example, the angle body 16 shown in FIGS. 35-42 can be fitted with a shaft 21, secured with a common pin, to serve as a fitting for the attachment of any number of accessories, from the structural (e.g. tension wires to add strength to a framed structure) to the functional (e.g. as an attachment point for a slide on a pool structure or outdoor lights on a tiny house) to the decorative (e.g. as an anchor for hanging decorative elements). This configuration is shown, from multiple perspectives, in FIGS. 43-50.

The addition of a second angle body 16 creates the angle assembly 24 illustrated in several views across FIGS. 51-56.

Angle assemblies 24 can be combined with a flange 4 and a connector 7 to allow structural members or other elements to be attached to various components at angles. This configuration is shown, in multiple views, in FIGS. 57-64.

Angle assemblies 24 can also be combined with two flanges 4 to allow structural members or other elements to be attached to one another at a range of angles. This configuration is shown, over multiple views, in FIGS. 65-72.

The versatility of the system is further enhanced when the shaft 21 is tapped with threaded holes 23, facilitating the addition of two more flanges 4, as shown in FIGS. 73-80.

Yet another embodiment of the angle assembly 24 is shown in FIGS. 81-88, where two connectors 7 have been attached to the angle bodies.

Tapped holes may be made along the long axis of the shaft 21, in order that additional flanges 4 can be attached to the shaft 21, facilitating the same number of flanges, six, as in the hub 1, with the additional versatility afforded by the motion of the bodies in this configuration, which is illustrated from perspective, side, and iso views in FIGS. 89-91, respectively.

A framing structure built via the system is comprised of structural member assemblies 25, as illustrated in FIGS. 92 and 93 in exploded and assembled states, respectively. Note that when assembled at the factory, as is a preferred configuration for this kit, the structural member assemblies 25 can be mated to—or unmated from—the flanges 4 (whether said flanges 4 are of the individual variety or configured as integral parts of a hub 1) without the use of tools.

Referring now to FIGS. 94 and 95, a structural assembly comprised of right angles may be created by slidably mating as many as six structural member assemblies 25, to a hub 1 by sliding the members' respective connectors onto the hub 1 from any of four directions. These structures are shown in exploded and assembled states, respectively. This system allows for any of the assemblies 25 to be attached to, or detached from, the hub 1 in any order, without impeding the access or travel of any adjacent members.

Angled structures may also be built using the system by means illustrated in the perspective and iso views, respectively, of FIGS. 113 and 114. Structural assemblies comprised of various angles may be created by mating structural member assemblies 25 to one another by sliding the assemblies' respective connectors onto the flanges of angle assemblies 24.

As will be evident in FIGS. 98 and 99, the addition of individual flanges 4 to select shafts 21 of angle assemblies 24 can facilitate the creation of structures of myriad forms, such as the hexagonal three-dimensional structure shown in assembled and exploded states, respectively.

Curvilinear structures are also possible using the system, as pictured in the perspective and exploded views, respectively, of FIGS. 100 and 101. In one of a plethora of possible configurations, these figures illustrate two curved members 28, bored with threaded holes along their flat surfaces, allowing for separate flanges 4 to connect in such a manner as to facilitate attachment, for example, of roof or ceiling panels 29 via connectors 7. The curved members 28 are secured to the hubs 1 and independent flanges 4 of the frame via connectors 7 attached to their bases.

Another method of connecting hubs 1 and flanges 4 to structural members or assemblies is demonstrated in FIGS. 102 and 103. Here, in but one example of many possible designs, hubs 1 slide into specially shaped cutouts in a structural body 30. Such cutouts, which facilitate securing hubs 1 to structural members of numerous compositions and embodiments, give the system nearly innumerable further functional possibilities.

Referring now to FIGS. 104 and 105, which bring together many of the components of the system described above in a simple illustrative structure, shown in perspective views of intact and exploded states, respectively. The structure illustrated in FIG. 104 is one of a virtually infinite number of structures that can be made using the components and system of the present invention. This structure, however, illustrates many of the basic components and many of the variations of the present invention. The simple structure includes several right-angle connections of straight structural members, facilitated by hubs 1 and independent flanges 4. Angled connections of straight structural members facilitated by angle assemblies 24 are also illustrated, as is an angled cross-brace, and a curved member 28 appended by flanges 4 and connectors 7. Each of these members connects to the structure using the various connection components discussed above. Each of the components described and illustrated herein, and the myriad possible variations thereon, may be made of a wide variety of materials and attached to the components described via a plethora of means.

Referring now to FIG. 105, and specifically to panels 14, it is important to note that the material comprising the front, smaller panel of panels 14 has been machined or otherwise formed to clear the additional bodies 11 that allow the connector 7 to protrude into the T-slot channels 27 (as illustrated in FIG. 92).

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A system for framing structures comprising:

a plurality of hexahedral hubs, each having a plurality of faces, wherein at least two faces of the hub include an integral, rectilinear projection and flange structure;

a plurality of elongated structural members; and a plurality of interface connectors including: a first side formed to slidably mate with a face of the hub and an associated rectilinear projection, and a second side configured to removably attach to one or more of the elongated structural members via a connection component extending through the interface connector;

wherein the first side of each interface connector includes an opening configured to slidably accept a rectilinear projection via substantially parallel sides such that the flange structure is substantially encompassed by the interface connector.

2. The system for framing structures of claim 1, wherein an interface connector selected from the plurality of interface connectors may slidably mount to any face of the hub from a plurality of orientations.

3. The system for framing structures of claim 1, wherein the interface connector may be slidably attached to, and detached from, a face of a hub from a plurality of orientations without interfering with another connector's ability to mount to any other face of the hub.

4. The system for framing structures of claim 1, wherein the interface connector incorporates an aperture, allowing for elements to pass through the interface connector and into framing members and other bodies.

5. The system for framing structures of claim 1, wherein a connector selected from the plurality of interface connectors, structural member, or other body attached via the interface connector is removable from a hub without moving the hub.

6. The system for framing structures of claim 1, wherein the interface connector includes a rectangular-shaped opening that prevents the connector from rotating with respect to the flange structure.

7. A building system comprising:

a plurality of hexahedral hubs, each having a plurality of faces, wherein at least two faces of the hub include a removably attached rectilinear projection and flange structure;

a plurality of elongated structural members; and a plurality of interface connectors having a first side formed to slidably mate with a face of the hub and an associated projection, and a second side configured to removably attach to one or more of the elongated structural members via a connection component extending through the interface connector;

wherein the first side of the interface connectors includes an opening configured to slidably accept the rectilinear projection via substantially parallel sides such that the flange structure is substantially encompassed by the interface connector.

8. The system of claim 7, wherein the hub is formed to accept the flanged structure on at least two of the hub's six faces.

9. The system of claim 7, wherein the flanged structure is configured to connect to the hub and to other bodies.

10. The system of claim 7, wherein the connector is formed to mate with the flange structure, wherein the flange structure is configured to be attached to substantially flat surfaces other than the hub's faces.

11. A system for framing structures comprising:

a non-solid hub having six sides, comprising attachment points on all six sides to define the planes of a hexahedron;

a shaft that bisects a central axis of the hub;

a rectilinear flange structure attachable to at least two points on the hub; and a plurality of removable interface connectors formed to slidably mate with the flange structure, and configured to removably attach to elongated structural members via a connection component extending through the interface connector;

wherein the first side of the interface connectors includes an opening configured to slidably accept the rectilinear projection via substantially parallel sides such that the flange structure is substantially encompassed by the interface connector.

12. The system for framing structures of claim 11, wherein an interface connector may slidably mount to any of the flange structures of the hub from a plurality of orientations.

13. The system for framing structures of claim 11, wherein the interface connector may be slidably attached to, and detached from, a flanged structure of a hub from a plurality of orientations without interfering with another connector's ability to mount to any other flange structure of the hub.

14. The system for framing structures of claim 11, wherein the interface connector incorporates an aperture, allowing for elements to pass through the connector and into framing members and other bodies.

15. The system for framing structures of claim 11, wherein an interface connector, structural member, or other body attached via the interface connector is mountable and removable from a hub without removing the hub from a structure.

16. The system for framing structures of claim 11, wherein the interface connector includes a rectangular-shaped opening which prevents the connector from rotating with respect to the flanged projection.

17. The system for framing structures of claim 11, wherein the shaft is machined at its ends to accommodate flanged projections and other attachable bodies.

* * * * *